US012584255B2

(12) United States Patent
Neely et al.

(10) Patent No.: US 12,584,255 B2
(45) Date of Patent: Mar. 24, 2026

(54) TUFTING MACHINE AND METHOD OF TUFTING

(71) Applicant: Card-Monroe Corp., Chattanooga, TN (US)

(72) Inventors: Marshall Allen Neely, Soddy Daisy, TN (US); Ricky E. Mathews, Sale Creek, TN (US); Wilton Hall, Ringgold, GA (US)

(73) Assignee: Card-Monroe, Corp., Chattanooga, TN (US)

( * ) Notice: Subject to any disclaimer, the term of this patent is extended or adjusted under 35 U.S.C. 154(b) by 0 days.

(21) Appl. No.: 19/035,236

(22) Filed: Jan. 23, 2025

(65) Prior Publication Data

US 2025/0230593 A1 Jul. 17, 2025

Related U.S. Application Data

(63) Continuation of application No. 18/199,710, filed on May 19, 2023, now Pat. No. 12,234,587, and a continuation of application No. 29/888,841, filed on Apr. 5, 2023, now Pat. No. Des. 1,056,680, said application No. 18/199,710 is a continuation-in-part of application No. 18/168,928, filed on Feb. 14, 2023, now Pat. No. 12,129,586, which is a continuation of application No. 17/353,995, filed on Jun. 22, 2021, now Pat. No. 11,585,029.

(60) Provisional application No. 63/463,758, filed on May 3, 2023, provisional application No. 63/149,957, filed on Feb. 16, 2021.

(51) Int. Cl.
*D05C 15/22* (2006.01)
*D05C 15/14* (2006.01)

(52) U.S. Cl.
CPC ..... *D05C 15/22* (2013.01); *D05C 15/14* (2013.01)

(58) Field of Classification Search
CPC ..... D05C 15/22; D05C 15/14; D05C 15/00; D05C 15/04; D05C 15/08; D05C 15/10; D05C 15/16; D05C 15/12
See application file for complete search history.

(56) References Cited

U.S. PATENT DOCUMENTS 2,423,607 A * 7/1947 Mccutchen ..... D05C 15/00 112/80.55
2,811,244 A * 10/1957 Maccaffray, Jr. ..... D05C 15/00 226/114

(Continued)

*Primary Examiner* — Danny Worrell
(74) *Attorney, Agent, or Firm* — Adams & Reese LLP

(57) ABSTRACT

A tufting machine for selectively forming tufts of yarns, including different color or type yarns, for forming patterned tufted articles such as carpets. A series of needles are reciprocated into and out of a backing material being fed through the tufting machine and are engaged by a series of gauge parts so as to pick-up loops of yarns from the needles. The gauge parts will be selectively controlled by activators to extend or retract the gauge parts to positions or elevations sufficient to pick-up or not pick-up loops of yarns from the needles. The feeding of the yarns to the needles further will be controlled to back-rob yarns not picked-up by the gauge parts, while the backing feed will be controlled to enable formation of tufts at an increased rate over the pattern stitch rate for the pattern of the tufted article being formed.

20 Claims, 13 Drawing Sheets

(56) References Cited

U.S. PATENT DOCUMENTS 2,818,037 A * 12/1957 Mcnutt ..... D05C 15/14 112/80.32
2,827,866 A * 3/1958 Penman ..... D05C 15/22 112/80.52
2,840,019 A * 6/1958 Beasley ..... D05C 15/00 112/80.32
2,842,080 A * 7/1958 Hoeselbarth ..... D05C 15/32 112/80.55
2,842,259 A * 7/1958 Hoeselbarth ..... D04B 15/38 112/80.24
2,850,994 A * 9/1958 Crawford ..... D05C 15/32 112/80.52
2,860,588 A * 11/1958 Penman ..... D05C 15/22 112/80.23
2,866,424 A * 12/1958 Masland ..... B65H 51/16 112/DIG. 1
2,879,729 A * 3/1959 Mccutchen ..... D05C 15/36 112/80.52
2,882,845 A * 4/1959 Hoeselbarth ..... D05C 15/26 112/80.55
2,883,735 A * 4/1959 Hoeselbarth ..... D05C 15/00 428/93
2,932,181 A * 4/1960 Maccaffray, Jr. ..... D04B 15/38 66/84 R
2,965,054 A * 12/1960 Masland ..... D05C 15/00 112/80.7
2,966,866 A * 1/1961 Card ..... D05C 15/18 226/9
2,968,856 A * 1/1961 Allen ..... D06H 1/00 548/259
2,982,239 A * 5/1961 Mccutchen ..... D05C 15/36 112/80.52
2,982,240 A * 5/1961 Mccutchen ..... D05C 15/36 112/80.52
2,983,028 A * 5/1961 Morrison ..... D05C 15/145 428/102
2,985,124 A * 5/1961 Rice ..... D05C 15/36 112/80.72
2,990,792 A * 7/1961 Nowicki ..... D05C 15/36 112/80.01
2,991,738 A * 7/1961 Zenner ..... D05C 15/26 112/80.24
3,016,029 A * 1/1962 Card ..... D05C 15/00 112/80.43
3,026,029 A * 3/1962 Daniels ..... G06K 19/10 235/489
3,026,830 A * 3/1962 Bryant ..... D05C 15/30 112/98
3,052,198 A * 9/1962 Whitney ..... D05C 15/36 112/80.52
3,056,364 A * 10/1962 Dedmon ..... D05C 15/20 112/80.43
3,067,701 A * 12/1962 Wilcox ..... D05C 15/26 112/80.24
3,075,481 A * 1/1963 Stratton ..... D05C 15/00 112/221
3,084,644 A * 4/1963 Card ..... D05C 15/00 112/80.32
3,084,645 A * 4/1963 Card ..... D05C 15/36 112/80.51
3,091,199 A * 5/1963 Ballard ..... D05C 15/26 112/80.32
3,095,840 A * 7/1963 Ballard ..... D05C 15/22 112/475.22
3,095,841 A * 7/1963 Ballard ..... D05C 15/32 112/80.54
3,103,903 A * 9/1963 Broadrick ..... D05C 15/32 226/110
3,108,553 A * 10/1963 Beasley ..... D05C 15/32 112/80.43
3,108,554 A * 10/1963 Payne ..... D05C 15/32 112/80.23
3,109,395 A * 11/1963 Batty ..... D05C 15/30 112/80.31
3,138,126 A * 6/1964 Card ..... D05C 15/22 112/80.51
3,160,125 A * 12/1964 Payne ..... D03D 39/06 112/80.43
3,162,155 A * 12/1964 Charles ..... D05C 15/32 112/221
3,177,833 A * 4/1965 Passons ..... D05C 15/12 112/80.43
3,202,379 A * 8/1965 Wrighton et al. ..... B60R 22/38 242/384.7
3,203,379 A * 8/1965 Dedmon ..... D05C 15/22 112/80.52
3,203,388 A * 8/1965 Parlin ..... D05C 17/026 112/410
3,220,371 A * 11/1965 Short ..... D05C 15/34 112/80.08
3,229,652 A * 1/1966 Ridyard ..... D05C 15/00 112/80.15
3,259,088 A * 7/1966 Rockholt ..... D05C 15/20 112/475.23
3,272,163 A * 9/1966 Erwin, Jr. ..... D05C 15/26 112/80.24
3,332,379 A * 7/1967 Cobble, Sr. ..... D05C 15/145 112/80.33
3,361,096 A * 1/1968 Watkins ..... D05C 15/00 112/80.15
3,375,797 A * 4/1968 Gaines ..... D05C 15/32 112/80.24
3,386,398 A * 6/1968 Cobble, Sr. ..... D05C 15/24 30/304
3,386,403 A * 6/1968 Short ..... D05C 15/26 112/80.71
3,393,654 A * 7/1968 Barnes ..... D05C 15/28 112/80.31
3,396,687 A * 8/1968 Nowicki ..... D05C 15/20 112/80.4
3,421,929 A * 1/1969 Watkins ..... D05C 15/145 66/194
3,433,188 A * 3/1969 Pickles ..... D03C 3/20 112/80.23
3,435,787 A * 4/1969 Short ..... D05C 15/32 250/548
3,485,195 A * 12/1969 Torrence ..... D05C 15/20 112/226
3,490,399 A * 1/1970 Hesz ..... D05B 11/00 112/118
3,511,195 A * 5/1970 Hasler ..... D05C 15/00 112/80.32
3,547,058 A * 12/1970 James ..... D05C 15/20 112/80.43
3,554,147 A * 1/1971 Spanel ..... D03D 39/02 112/80.07
3,577,943 A * 5/1971 Watkins ..... D05C 15/28 112/80.31
3,585,948 A * 6/1971 Cobble ..... D05C 15/26 112/80.55
3,605,660 A * 9/1971 Short ..... D05C 15/18 192/48.91
3,618,542 A * 11/1971 Zocher ..... D05C 15/20 112/222
3,618,543 A * 11/1971 Wittler ..... D05C 15/32 112/80.54
3,618,544 A * 11/1971 Watkins ..... D05C 15/22 112/80.55
3,623,440 A * 11/1971 Spedding ..... D05C 15/00 112/80.71
3,626,878 A * 12/1971 Cobble ..... D05C 15/22 112/80.55
3,662,697 A * 5/1972 Passons ..... D05C 15/24 112/80.55
3,670,672 A * 6/1972 Spanel ..... D05C 15/20 26/9
3,688,804 A * 9/1972 Brown ..... D06H 1/00 139/1 R

(56) References Cited

U.S. PATENT DOCUMENTS 3,701,464 A * 10/1972 Crum ..... B41F 13/14 101/248
3,709,173 A * 1/1973 Greene ..... D05C 15/20 112/80.45
3,735,715 A * 5/1973 Passons ..... D05C 15/22 D8/15
3,752,094 A * 8/1973 Short ..... D05C 15/18 112/80.16
3,752,095 A * 8/1973 Brown ..... D05C 15/12 112/80.23
3,757,709 A * 9/1973 Cobble ..... D05C 15/24 83/699.61
3,812,799 A * 5/1974 Spanel ..... D05C 15/20 112/80.55
3,824,939 A * 7/1974 Spanel ..... D05C 15/24 112/80.07
3,830,174 A * 8/1974 Mellor ..... D05C 15/20 112/80.42
3,835,797 A * 9/1974 Franks ..... D05C 15/32 112/80.73
3,842,767 A * 10/1974 Short ..... D05C 15/14 112/80.32
3,847,098 A * 11/1974 Hammel, Jr. ..... D05C 15/32 112/80.73
3,850,120 A * 11/1974 Jackson ..... D05C 15/22 112/80.5
3,865,059 A * 2/1975 Jackson ..... D05C 15/14 26/96
3,875,883 A * 4/1975 Eberwein ..... B65H 57/12 112/475.08
3,881,432 A * 5/1975 Dodd ..... D05C 15/32 112/221
3,908,570 A * 9/1975 Puckett ..... D05C 17/026 112/410
3,908,881 A * 9/1975 McCann ..... B65H 23/0208 226/23
3,919,952 A * 11/1975 Lund ..... D05C 15/20 411/398
3,919,953 A * 11/1975 Card ..... D05C 15/24 112/80.52
3,934,524 A * 1/1976 Smith ..... D05C 15/28 112/461
3,937,156 A * 2/1976 Spanel ..... D05C 15/00 83/402
3,937,157 A * 2/1976 Spanel ..... D05C 15/18 83/402
3,937,158 A * 2/1976 Spanel ..... D05C 15/00 83/402
3,937,159 A * 2/1976 Spanel ..... D05C 15/00 112/80.71
3,937,160 A * 2/1976 Spanel ..... D05C 15/18 226/97.4
3,943,865 A * 3/1976 Short ..... D05C 15/32 112/80.24
3,972,295 A * 8/1976 Smith ..... D05C 15/30 112/80.41
3,978,800 A * 9/1976 Card ..... D05C 15/20 112/80.4
3,982,491 A * 9/1976 Herzer ..... D05B 21/00 112/102.5
4,015,550 A * 4/1977 Bartenfeld ..... D06B 11/0026 112/80.32
4,029,030 A * 6/1977 Smith ..... D05C 17/026 112/80.51
4,047,491 A * 9/1977 Spanel ..... D05C 15/34 112/80.07
4,048,930 A * 9/1977 Card ..... D05C 15/32 112/80.51
4,064,816 A * 12/1977 Spanel ..... D05C 15/20 112/80.43
4,089,281 A * 5/1978 Landoni ..... D05C 15/20 112/83
4,100,863 A * 7/1978 Shortte, Jr. ..... D05C 15/28 112/80.08
4,103,629 A * 8/1978 Card ..... D05C 15/36 112/80.51
4,106,416 A * 8/1978 Blackstone, Jr. ..... D05C 15/34 112/80.71
4,119,047 A * 10/1978 Spanel ..... D05C 15/24 112/80.71
4,127,078 A * 11/1978 Spanel ..... D05C 15/16 112/80.71
4,134,347 A * 1/1979 Jolley ..... D05C 15/36 112/80.51
4,134,348 A * 1/1979 Scott ..... D05C 15/18 226/108
4,138,956 A * 2/1979 Parsons ..... D05C 15/20 112/226
4,149,477 A * 4/1979 Corbo ..... D04B 35/04 112/222
4,154,176 A * 5/1979 Spanel ..... D05C 15/20 403/324
4,155,318 A * 5/1979 Yamamoto ..... D05C 15/22 112/80.59
4,155,319 A * 5/1979 Short ..... D05C 15/36 112/80.51
4,170,949 A * 10/1979 Lund ..... D05C 15/20 112/226
4,173,192 A * 11/1979 Schmidt ..... G05B 19/351 112/80.24
4,185,569 A * 1/1980 Inman ..... D05C 15/36 112/80.51
4,193,358 A * 3/1980 Woodcock ..... D05C 15/26 112/80.24
4,195,580 A * 4/1980 Hurst ..... D05C 15/24 112/80.6
4,207,825 A * 6/1980 Bleasdale ..... D05C 15/24 112/80.6
4,211,176 A * 7/1980 Price ..... D05C 15/24 112/80.6
4,217,836 A * 8/1980 Scott ..... D05C 15/24 112/289
4,217,837 A * 8/1980 Beasley ..... D05C 15/22 112/80.55
4,221,317 A * 9/1980 Fukada ..... D05C 15/18 226/188
4,224,884 A * 9/1980 Shortte, Jr. ..... D05C 15/28 112/80.31
4,241,675 A * 12/1980 Bardsley ..... D05C 15/22 112/80.51
4,241,676 A * 12/1980 Parsons ..... D05C 15/22 112/80.51
4,244,309 A * 1/1981 Spanel ..... D05C 15/20 112/80.4
4,245,574 A * 1/1981 Wilson ..... D05C 15/32 112/80.51
4,245,794 A * 1/1981 Hasegawa ..... B65H 59/385 242/413.3
4,254,718 A * 3/1981 Spanel ..... D05C 15/28 112/80.23
4,255,050 A * 3/1981 Beckstein ..... D06H 3/125 356/429
4,261,498 A * 4/1981 Short ..... D06C 3/06 26/51.4
4,267,787 A * 5/1981 Fukuda ..... D05C 15/14 112/272
4,285,286 A * 8/1981 Hash ..... D05C 17/02 112/80.53
4,301,751 A * 11/1981 Caylor ..... D05C 15/24 112/80.32
4,301,752 A * 11/1981 Ingram ..... D05C 15/36 112/80.55
4,303,024 A * 12/1981 Bardsley ..... D05C 15/22 29/445
4,303,189 A * 12/1981 Wiley ..... B65H 23/0216 250/548
4,313,388 A * 2/1982 Biggs ..... D05C 15/22 112/80.53

(56) References Cited

U.S. PATENT DOCUMENTS 4,317,419 A * 3/1982 Spanel ..... D05C 15/00 112/475.23
4,320,711 A * 3/1982 Slattery ..... D05C 15/22 112/80.52
4,353,317 A * 10/1982 Crumbliss ..... D05C 15/22 112/80.51
4,354,441 A * 10/1982 Hurst ..... D05C 15/24 112/80.6
4,365,565 A * 12/1982 Kawai ..... D05B 21/00 112/103
4,366,761 A * 1/1983 Card ..... D05C 15/30 112/80.23
4,369,720 A * 1/1983 Beasley ..... D05C 15/22 112/80.51
4,370,937 A * 2/1983 Denny ..... D05C 15/00 112/80.3
4,384,538 A * 5/1983 Slattery ..... D05C 15/12 112/80.3
4,393,793 A * 7/1983 Beasley ..... D05C 15/18 112/80.7
4,397,249 A * 8/1983 Slattery ..... D05C 15/22 112/80.55
4,399,758 A * 8/1983 Bagnall ..... D05C 15/30 112/80.41
4,401,024 A * 8/1983 Frentress ..... H04N 1/506 101/93.01
4,419,944 A * 12/1983 Passons ..... D05C 15/22 112/80.55
4,429,648 A * 2/1984 Slattery ..... D05C 15/20 112/80.45
4,440,102 A * 4/1984 Card ..... D05C 15/30 112/80.41
4,445,447 A * 5/1984 Bardsley ..... D05C 15/30 112/80.31
4,448,137 A * 5/1984 Curtis ..... D05C 15/22 112/80.5
4,466,366 A * 8/1984 Hirotsu ..... D05C 15/22 112/80.56
4,469,037 A * 9/1984 Bost, Jr. ..... D05C 15/00 112/80.23
4,483,260 A * 11/1984 Gallant ..... D05C 15/30 112/80.23
4,491,078 A * 1/1985 Ingram ..... D05C 15/22 112/80.5
4,501,212 A * 2/1985 Slattery ..... D05C 15/26 112/80.41
4,509,439 A * 4/1985 Densmore ..... D05C 15/22 112/80.5
4,519,332 A * 5/1985 Fukuda ..... D05C 15/14 112/272
4,522,132 A * 6/1985 Slattery ..... D05C 15/22 112/80.51
4,528,921 A * 7/1985 Slattery ..... D05C 15/24 112/80.6
4,531,465 A * 7/1985 Hampton ..... D05C 15/34 112/80.73
4,548,140 A * 10/1985 Price ..... D05C 15/145 112/80.3
4,549,496 A * 10/1985 Kile ..... D05C 15/34 112/80.08
4,557,208 A * 12/1985 Ingram ..... D05C 15/26 112/80.32
4,557,209 A * 12/1985 Watkins ..... D05C 15/32 112/80.55
4,559,885 A * 12/1985 Card ..... D05C 15/22 112/80.15
4,562,781 A * 1/1986 Green ..... D05C 15/22 112/80.5
4,574,716 A * 3/1986 Czelusniak, Jr. ..... D05C 15/20 112/80.41
4,586,445 A * 5/1986 Card ..... D05C 15/20 112/80.4
4,587,914 A * 5/1986 Card ..... D05C 15/22 112/80.4
4,597,344 A * 7/1986 Stutznacker ..... D05B 11/00 112/475.04
4,608,935 A * 9/1986 Bardsley ..... D05C 15/18 112/80.73
4,619,212 A * 10/1986 Card ..... D05C 15/30 112/80.4
4,630,558 A * 12/1986 Card ..... D05C 15/30 112/410
4,637,329 A * 1/1987 Czelusniak, Jr. ..... D05C 15/20 112/80.41
4,653,293 A * 3/1987 Porat ..... D04B 27/28 66/207
4,653,413 A * 3/1987 Bagnall ..... D05C 15/20 112/80.41
4,658,739 A * 4/1987 Watkins ..... D05C 15/145 112/80.3
4,665,845 A * 5/1987 Card ..... D05C 15/20 112/80.4
4,667,611 A * 5/1987 Yamamoto ..... D05B 73/12 112/166
4,669,171 A * 6/1987 Card ..... D05C 15/22 29/446
4,669,403 A * 6/1987 Bagnall ..... D05C 15/20 112/80.4
4,682,554 A * 7/1987 Goto ..... D05B 69/20 112/315
4,686,918 A * 8/1987 Hjalmer ..... D05B 21/007 112/80.23
4,688,497 A * 8/1987 Card ..... D05C 15/18 112/80.73
4,693,190 A * 9/1987 Slattery ..... D05C 15/145 112/80.3
D293,323 S * 12/1987 Slattery ..... D15/78
4,726,306 A * 2/1988 Crumbliss ..... D05C 15/14 112/80.32
4,739,717 A * 4/1988 Bardsley ..... D05C 15/22 112/80.5
4,741,000 A * 4/1988 Fukuda ..... H03K 17/941 377/16
4,786,177 A * 11/1988 Beckstein ..... D06H 3/125 356/429
4,790,252 A * 12/1988 Bardsley ..... D05C 15/34 112/80.43
4,793,271 A * 12/1988 Magourik ..... D05C 15/24 112/80.6
4,794,874 A * 1/1989 Slattery ..... D05C 15/26 112/475.23
4,800,828 A * 1/1989 Watkins ..... D05C 15/30 112/80.52
4,815,401 A * 3/1989 Bagnall ..... D05C 15/26 112/80.41
4,815,402 A * 3/1989 Price ..... D05C 15/12 112/80.44
4,815,403 A * 3/1989 Card ..... D05C 15/36 112/80.51
4,817,541 A * 4/1989 Magourik ..... D05C 15/24 112/80.6
4,829,917 A * 5/1989 Morgante ..... D05C 15/30 112/80.41
4,831,948 A * 5/1989 Itoh ..... D05C 15/20 112/80.44
4,836,118 A * 6/1989 Card ..... D05C 15/30 112/80.52
4,840,133 A * 6/1989 Watkins ..... D05C 15/145 112/80.52
4,841,886 A * 6/1989 Watkins ..... D05C 15/145 112/80.52
4,849,270 A * 7/1989 Evans ..... E06B 7/22 428/95
4,852,505 A * 8/1989 Dedmon ..... D05C 15/20 112/80.42
4,856,441 A * 8/1989 Kurata ..... D05C 15/18 112/80.54

(56) References Cited

U.S. PATENT DOCUMENTS 4,860,673 A * 8/1989 Ward ..... D05C 15/08 112/80.4
4,860,674 A * 8/1989 Slattery ..... D05C 15/10 112/80.55
4,864,946 A * 9/1989 Watkins ..... D05C 15/32 112/80.73
4,867,080 A * 9/1989 Taylor ..... D05C 15/145 112/80.32
4,870,915 A * 10/1989 Bagnall ..... D05C 15/18 112/80.41
4,890,924 A * 1/1990 Beckstein ..... D06H 3/125 356/429
4,903,624 A * 2/1990 Card ..... D05C 15/04 112/410
4,903,625 A * 2/1990 Card ..... D05C 15/30 112/410
4,991,523 A * 2/1991 Ingram ..... D05C 15/24 112/80.08
5,005,498 A * 4/1991 Taylor ..... D05C 15/32 112/80.32
5,035,030 A * 7/1991 Pellari ..... D06C 3/06 26/51.5
5,042,405 A * 8/1991 Bradley ..... D05C 15/18 112/80.01
5,058,518 A * 10/1991 Card ..... D05C 15/26 112/80.23
5,080,028 A * 1/1992 Ingram ..... D05C 15/18 112/80.08
5,094,178 A * 3/1992 Watkins ..... D05C 15/32 112/25
5,143,003 A * 9/1992 Dedmon ..... D05C 15/20 112/DIG. 3
5,158,027 A * 10/1992 Ingram ..... D05B 29/06 112/235
5,165,352 A * 11/1992 Ingram ..... D05C 15/34 112/80.08
5,182,997 A * 2/1993 Bardsley ..... D05C 15/18 112/302
5,189,966 A * 3/1993 Satterfield ..... D05C 15/20 112/222
5,205,229 A * 4/1993 Job ..... D05C 15/30 112/80.41
5,205,233 A * 4/1993 Ingram ..... D05C 15/28 114/294
5,224,434 A * 7/1993 Card ..... D05C 15/30 112/80.52
5,267,520 A * 12/1993 Ingram ..... D05C 15/28 112/410
5,295,450 A * 3/1994 Neely ..... D05C 15/22 112/80.6
5,383,415 A * 1/1995 Padgett, III ..... D05C 15/34 112/80.73
5,392,723 A * 2/1995 Kaju ..... D05C 15/26 112/80.23
5,413,832 A * 5/1995 Willey ..... D05C 15/34 428/92
5,416,593 A * 5/1995 Vercruysse ..... D06H 3/125 356/429
5,458,075 A * 10/1995 Tice ..... D05B 19/12 112/155
5,461,996 A * 10/1995 Kaju ..... D05C 15/26 112/475.23
5,480,085 A * 1/1996 Smithe ..... B26D 5/30 226/118.3
5,484,639 A * 1/1996 Woodall ..... D06N 7/0073 428/95
5,491,372 A * 2/1996 Erhart ..... F16H 25/2252 310/80
5,495,815 A * 3/1996 Bagnall ..... D05C 15/24 112/80.55
5,501,250 A * 3/1996 Edwards ..... D05C 11/16 139/453
5,505,150 A * 4/1996 James ..... D05C 15/16 112/117
5,509,364 A * 4/1996 Bardsley ..... D05C 15/22 112/80.51
5,513,586 A * 5/1996 Neely ..... D05C 15/22 112/80.01
5,526,760 A * 6/1996 Ok ..... D05C 15/30 74/99 R
5,529,002 A * 6/1996 Piller ..... D05C 15/20 112/80.43
5,544,605 A * 8/1996 Frost ..... D05C 15/26 112/80.73
5,557,154 A * 9/1996 Erhart ..... F16H 25/2252 417/415
5,560,307 A * 10/1996 Padgett, III ..... D05C 17/026 112/80.15
5,562,056 A * 10/1996 Christman, Jr. ..... D05C 15/32 112/80.33
5,566,629 A * 10/1996 Satterfield ..... D05C 15/32 112/80.01
5,566,630 A * 10/1996 Burgess ..... D05C 15/30 112/80.41
5,575,228 A * 11/1996 Padgett, III ..... D05C 15/16 112/80.01
5,588,383 A * 12/1996 Davis ..... D05C 15/24 112/80.16
5,622,126 A * 4/1997 Card ..... D05C 15/18 112/80.73
5,645,001 A * 7/1997 Green ..... D05C 15/22 112/80.55
5,653,184 A * 8/1997 Bardsley ..... D05B 71/00 112/80.01
5,662,054 A * 9/1997 Bardsley ..... D05C 15/18 112/470.01
5,706,745 A * 1/1998 Neely ..... D05C 15/22 112/80.55
5,738,027 A * 4/1998 White ..... D05C 15/24 26/8 R
5,738,030 A * 4/1998 Ok ..... D05C 15/34 112/80.23
5,743,200 A * 4/1998 Miller ..... D05C 15/08 112/80.01
5,743,201 A * 4/1998 Card ..... D05C 15/18 112/80.73
5,794,551 A * 8/1998 Morrison ..... D05C 15/30 112/80.41
5,806,446 A * 9/1998 Morrison ..... D05C 15/32 112/80.73
5,809,917 A * 9/1998 McGowan ..... D05C 15/14 112/80.32
5,896,821 A * 4/1999 Neely ..... D05C 15/22 112/80.52
5,899,152 A * 5/1999 Bardsley ..... D05C 15/18 112/80.73
5,954,003 A * 9/1999 Beyer ..... D05C 15/20 112/80.45
5,974,991 A * 11/1999 Bardsley ..... D05C 15/20 112/80.45
5,979,344 A * 11/1999 Christman, Jr. ..... D05C 15/28 112/80.23
5,983,815 A * 11/1999 Card ..... D05C 15/18 112/80.73
5,989,368 A * 11/1999 Tillander ..... B65H 23/0216 156/379
6,009,818 A * 1/2000 Card ..... D05C 15/18 112/80.73
6,116,173 A * 9/2000 Beyer ..... D05C 15/20 112/80.6
6,155,187 A * 12/2000 Bennett ..... D05C 15/24 112/80.51
6,192,814 B1 * 2/2001 Beverly ..... D05C 15/22 112/80.55
6,196,145 B1 * 3/2001 Burgess ..... D05B 23/00 112/80.16
6,202,580 B1 * 3/2001 Samilo ..... D05C 15/24 112/80.73

(56) References Cited

U.S. PATENT DOCUMENTS 6,213,036 B1 * 4/2001 Slattery ..... D05C 15/18 112/80.73
6,224,203 B1 * 5/2001 Wotton ..... B41J 11/0085 347/101
6,228,460 B1 * 5/2001 Hamilton ..... D05C 15/34 428/95
6,230,638 B1 * 5/2001 Ownbey ..... D05C 15/16 112/80.7
6,244,203 B1 * 6/2001 Morgante ..... D05C 15/18 242/364
6,263,811 B1 * 7/2001 Crossley ..... D05C 15/20 112/80.4
6,273,011 B1 * 8/2001 Amos ..... D05C 15/34 112/222
6,279,497 B1 * 8/2001 Lovelady ..... D05C 15/12 112/80.52
6,283,053 B1 * 9/2001 Morgante ..... D05C 15/32 112/220
6,293,211 B1 * 9/2001 Samilo ..... D05C 15/32 112/80.23
6,401,639 B1 * 6/2002 Samilo ..... D05C 15/18 112/80.73
6,409,030 B1 * 6/2002 Schlemper ..... D05C 15/20 211/70.6
6,431,097 B1 * 8/2002 Meade ..... D05C 15/22 112/80.5
6,446,566 B1 * 9/2002 Bennett ..... D05C 15/18 112/80.73
6,457,224 B1 * 10/2002 Kanjanavikat ..... H01L 21/4842 83/687
6,550,407 B1 * 4/2003 Frost ..... D05C 15/18 112/220
6,651,571 B2 * 11/2003 Bennett ..... D05C 15/10 112/80.43
6,729,254 B2 * 5/2004 Mamiya ..... D05B 21/00 112/80.23
6,758,154 B2 * 7/2004 Johnston ..... D05C 15/18 112/80.73
6,776,109 B2 * 8/2004 Segars ..... D06H 3/12 112/80.23
6,807,917 B1 * 10/2004 Christman ..... D05C 15/34 112/80.23
6,823,900 B2 * 11/2004 Wildeman ..... D06C 11/00 139/420 R
6,827,030 B2 * 12/2004 Hicks ..... D05C 15/24 112/80.23
6,834,602 B1 * 12/2004 Hall ..... D05C 15/24 112/80.55
6,877,447 B2 * 4/2005 Frost ..... D05C 15/32 112/80.73
6,895,877 B1 * 5/2005 Weiner ..... D05C 15/32 112/80.7
6,902,789 B2 * 6/2005 Funasako ..... D05C 17/023 428/95
6,971,326 B1 * 12/2005 Clarke ..... D05C 15/24 112/80.55
7,083,841 B2 * 8/2006 Oakey ..... B44C 1/28 428/44
7,191,717 B2 * 3/2007 Green ..... D05C 15/16 112/80.45
7,216,598 B1 * 5/2007 Christman, Jr. ..... D05C 15/14 112/475.23
7,222,576 B2 * 5/2007 Kilgore ..... D05C 15/22 112/80.5
7,237,497 B2 * 7/2007 Johnston ..... D05C 15/22 112/80.6
7,243,513 B2 * 7/2007 Kohlman ..... D06Q 1/06 8/151
7,264,854 B2 * 9/2007 Stroppiana ..... E01C 13/08 428/17
7,296,524 B2 * 11/2007 Beverly ..... D05C 15/14 112/80.3
7,347,151 B1 * 3/2008 Johnston ..... D05C 15/34 112/80.51
7,350,443 B2 * 4/2008 Oakey ..... A47G 27/0275 83/13
7,356,453 B2 * 4/2008 Gould ..... A47G 27/0275 703/22
7,426,895 B2 * 9/2008 Smith ..... D05C 15/14 112/80.32
7,431,974 B2 * 10/2008 Lovelady ..... D05C 17/026 112/80.01
7,438,007 B1 * 10/2008 Hall ..... D05C 15/22 112/80.51
7,478,605 B2 * 1/2009 Modra ..... D05C 15/20 112/80.01
7,490,566 B2 * 2/2009 Hall ..... D05C 15/36 112/80.4
7,520,229 B2 * 4/2009 Hillenbrand ..... D05C 15/24 112/80.5
7,562,632 B2 * 7/2009 Hillenbrand ..... D05C 15/22 112/80.55
7,682,686 B2 * 3/2010 Curro ..... D04H 1/544 428/156
7,685,952 B2 * 3/2010 Frost ..... D05C 15/18 112/80.73
7,707,953 B2 * 5/2010 Hillenbrand ..... D05C 15/36 112/80.55
7,717,049 B2 * 5/2010 Hillenbrand ..... D05C 15/22 112/80.55
7,717,051 B1 * 5/2010 Hall ..... D05B 19/16 112/80.32
7,946,233 B2 * 5/2011 Hall ..... D05C 15/12 112/80.4
8,082,862 B2 * 12/2011 Hillenbrand ..... D05C 15/22 112/80.59
8,127,698 B1 * 3/2012 Ingram ..... D05B 47/00 112/80.7
8,215,248 B2 * 7/2012 Kilgore ..... D05C 15/22 112/80.51
8,240,263 B1 * 8/2012 Frost ..... D05C 15/30 112/475.23
8,267,023 B2 * 9/2012 Samilo ..... D05C 15/18 112/80.01
8,915,202 B2 * 12/2014 Hall ..... D05C 15/22 112/80.5
9,139,943 B2 * 9/2015 Maddox ..... D05C 15/22
9,284,671 B2 * 3/2016 Gläsel ..... D05C 15/22
9,476,152 B2 * 10/2016 Card, Sr. ..... D05C 15/12
9,593,437 B2 * 3/2017 Mathews ..... D05C 15/24
9,657,419 B2 * 5/2017 Hall ..... D05C 15/22
9,915,017 B2 * 3/2018 Padgett ..... D05C 5/04
10,889,931 B2 * 1/2021 Beatty ..... D05C 15/14
11,028,513 B2 * 6/2021 Pintea ..... D05C 15/22
11,585,029 B2 * 2/2023 Neely ..... D05C 15/14
12,234,587 B2 * 2/2025 Neely ..... D05C 15/22
2002/0067483 A1 * 6/2002 Lacovara ..... G01N 21/64 356/431
2003/0131771 A1 * 7/2003 Green ..... D05C 15/22 112/80.6
2004/0025767 A1 * 2/2004 Card ..... D05C 15/34 112/80.73
2004/0253409 A1 * 12/2004 Whitten ..... D05C 15/34 428/88
2005/0109253 A1 * 5/2005 Johnston ..... D05C 15/20 112/80.44
2005/0188905 A1 * 9/2005 Dabrowa ..... D05C 15/34 112/102.5
2005/0204975 A1 * 9/2005 Card ..... D05C 15/18 112/80.73
2007/0077876 A1 * 4/2007 Rogers ..... B23K 1/0008 51/297
2007/0272137 A1 * 11/2007 Christman ..... D05C 15/26 112/80.01
2008/0072808 A1 * 3/2008 Johnston ..... D05C 15/20 112/475.18
2008/0134949 A1 * 6/2008 Bearden ..... D05C 15/34 112/80.41

(56) References Cited

U.S. PATENT DOCUMENTS

2008/0264315 A1* 10/2008 Neely ..... D05C 15/20 112/80.6
2009/0050036 A1* 2/2009 Jackson ..... D05C 15/22 112/80.4
2009/0056606 A1* 3/2009 Lovelady ..... D05C 15/22 112/80.51
2009/0205547 A1* 8/2009 Hall ..... D05C 15/36 112/80.41
2009/0260554 A1* 10/2009 Hall ..... D05C 11/00 112/80.4
2010/0101470 A1* 4/2010 Hillenbrand ..... D05C 15/22 427/404
2010/0132601 A1* 6/2010 Nakagawa ..... D05C 15/14 112/80.56
2012/0024208 A1* 2/2012 Buchle ..... D05C 15/24 112/80.5
2013/0180440 A1* 7/2013 Hall ..... D05C 15/16 112/80.32
2014/0000497 A1* 1/2014 Modra ..... D05C 15/12 112/80.32
2014/0272260 A1* 9/2014 Weiner ..... D05C 15/36 112/80.51
2014/0283724 A1* 9/2014 Frost ..... D05C 15/30 112/475.23
2014/0331906 A1* 11/2014 Hall ..... D05C 15/08 112/80.23
2016/0032510 A1* 2/2016 Hall ..... D05C 15/36 112/80.51
2016/0289880 A1* 10/2016 Hall ..... D05C 15/32
2017/0268144 A1* 9/2017 Hall ..... D05C 15/20
2019/0338453 A1* 11/2019 Hall ..... D05C 15/24
2020/0173084 A1* 6/2020 Pass ..... D04B 27/06
2020/0299886 A1* 9/2020 Detty ..... D05C 15/22
2020/0407902 A1* 12/2020 Padgett ..... D05C 15/28
2021/0017685 A1* 1/2021 Detty ..... D05C 15/10
2021/0047764 A1* 2/2021 Detty ..... D05C 15/30
2022/0403577 A1* 12/2022 Neely ..... D05C 15/145

* cited by examiner

TUFTING MACHINE AND METHOD OF TUFTING

CROSS REFERENCE TO RELATED APPLICATION

The present Patent Application is a continuation of co-pending U.S. patent application Ser. No. 18/199,710, filed May 19, 2023, which is a continuation in part of U.S. patent application Ser. No. 18/168,928, filed Feb. 14, 2023, now U.S. Pat. No. 12,129,586, issued on Oct. 29, 2024, which is a continuation of U.S. patent application Ser. No. 17/353,995, filed Jun. 22, 2021, now U.S. Pat. No. 11,585,029, issued on Feb. 21, 2023, which claims the benefit of U.S. Provisional Application No. 63/149,957, filed Feb. 16, 2021. The present Patent Application further is a continuation of U.S. Design patent application Ser. No. 29/888,841, filed Apr. 5, 2023, and claims benefit of U.S. Provisional Application No. 63/463,758, filed May 3, 2023.

INCORPORATION BY REFERENCE

U.S. patent application Ser. No. 18/199,710, filed May 19, 2023; U.S. patent application Ser. No. 18/168,928, filed Feb. 14, 2023, now U.S. Pat. No. 12,129,586, issued on Oct. 29, 2024; U.S. patent application Ser. No. 17/353,995, filed Jun. 22, 2021, now U.S. Pat. No. 11,585,029, issued on Feb. 21, 2023; U.S. Provisional Patent Application No. 63/149,957, filed Feb. 16, 2021; U.S. Design patent application Ser. No. 29/888,841, filed Apr. 5, 2023; and U.S. Provisional Patent Application No. 63/463,758, filed May 3, 2023 are specifically incorporated by reference herein as set forth in their entireties.

FIELD OF THE PRESENT DISCLOSURE

The present disclosure generally relates to tufting machines and methods of forming tufted fabrics. In particular, the present disclosure relates to tufting machines including selectively controllable gauge parts and modules or gauge blocks for carrying such gauge parts, as well as methods of forming patterned tufted fabrics.

BACKGROUND OF THE PRESENT DISCLOSURE

In the tufting field, particularly with regard to commercial and hospitality carpets, there has been increased demand for the production of carpets and rugs with new visual patterns, including the use of multiple different colors, in an effort to keep up with changing consumer tastes and increased competition in the marketplace. Carpet designers and manufacturers thus have placed increased emphasis on the creation of newer, different and more eye-catching patterns for carpets, rugs and other tufted fabrics, including patterns having the selective placement and display of yarns of particular colors or types within pattern fields thereof, and with the resultant tufted fabrics being formed with a substantially true pattern density of the visible tufts of the pattern. In particular, it has been desirable to try to replicate as closely as possible the look and feel of patterned carpets, rugs or other fabrics formed on a loom, but which can be created and formed therein on broadloom tufting machines so as to enable increased efficiencies in production of such patterned tufted carpets, rugs and/or other fabrics.

In addition, there generally is a desire to increase the speed of operation of tufting machines, to increase output therefrom. This means that gauge parts, such as loopers or hooks, as well as other parts such as needles, are subjected to increased machine cycles. As a result, these gauge parts and the modules or blocks carrying such gauge parts are subject to a higher incidence of wear and required replacement.

Accordingly, it can be seen that a need exists for a system and method of forming tufted fabrics such as carpets and rugs that addresses these and other related and unrelated problems in the art.

SUMMARY OF THE PRESENT DISCLOSURE

Briefly described, the present disclosure generally relates to a tufting machine and method of forming patterned tufted articles in which the placement and the pile height of tufts of yarns or stitches formed in a backing can be selectively controlled so as to enable formation of patterned tufted articles, such as carpets, having a variety of pattern effects, including the formation of tufted articles with free-flowing multi-color and/or multi-pile height patterns, as well as having substantially woven or loom formed appearances.

In one aspect, the tufting machine typically will include a control system for controlling the operative elements of the tufting machine to form or create tufted articles according to desired or designed patterns. The resultant tufted articles can include various pattern effects, including having multiple, varied or different pile heights, different types of tufts in the same and/or varying tuft rows, and other textured effects, as well as the placement of various color and/or type yarns to be visible at selected locations and pile heights across the backing; with, at least in some embodiments, the resultant tufted articles being provided with a density of retained and/or visible color yarns/stitches per inch that substantially matches a desired or prescribed pattern density or stitches per inch for the pattern being formed/tufted.

In embodiments, the tufting machine will include one or more needle bars having a series of needles mounted therealong. The needles can be arranged in in-line, staggered or other arrangements. As a backing material is fed through a tufting zone of the tufting machine, yarns will be introduced therein as the needles are reciprocated into and out of the backing material. A shift mechanism further can be provided for shifting the needle bar(s) transversely across the tufting zone, and multiple shift mechanisms can be utilized as needed. The shift mechanism(s) generally will be operable in response to instructions or communications from the control system, for stepping or shifting the needle bar(s) transversely across the backing in accordance with programmed and/or designed pattern shift steps for a pattern being tufted to present the yarns carried thereby to tuft or stitch locations along/across the backing.

The tufting machine further generally will include at least one yarn feed mechanism or attachment for controlling the feeding of the yarns to their respective needles. Such a yarn feed mechanism or pattern attachment can include, without limitation, various roll, scroll, servo-scroll, single end, double or multiple end yarn feed attachments, such as, for example, a Yarntronics™ or Infinity™/Infinity IIE™ yarn feed attachment as manufactured by Card-Monroe Corp. Other types of yarn feed control mechanisms also can be used. The at least one yarn feed mechanism or pattern attachment can be operated to selectively control feeding of yarns to their needles for forming tufts of yarns, which can include forming tufts having selected pile heights and/or forming no tufts, to create the desired pattern appearance.

In some embodiments, the control system can further comprise or operate with a stitch distribution control system, such as disclosed in U.S. Pat. No. 8,359,989 (the disclosure of which is incorporated by reference as if set forth fully herein); through which control of the backing feed and control of the operation of the shift mechanism(s) for shifting of at least a portion of the needles can be coordinated with control of the at least one yarn feed mechanism such that various yarns can be presented to various stitch locations or pixels, and the yarns to be shown on the face or surface of the tufted article generally can be fed in amounts sufficient to form tufts of desired heights while the non-appearing yarns, which are not to be shown in the tufted field, will be back-robbed or otherwise pulled sufficiently low and/or out of the backing. For each pixel or stitch location of the pattern, a series of yarns can be presented, and yarns not selected to be visible or appearing at such a stitch location can be pulled sufficiently low to be hidden and not interfere with the selected yarns to be visible. In some embodiments, this can include pulling a non-appearing or non-selected yarn out of the backing or leaving a sufficient portion of a non-appearing within the backing to hold or tack the non-selected or non-appearing yarns to the backing with interference with the face or retained, visible tufts of yarns of the pattern substantially minimized. Thus, in embodiments, only desired or selected yarns/colors to be placed at a particular stitch location may be retained at such stitch location, while the remaining yarns/colors can be hidden so as to not appear or show in the pattern fields being sewn at that time. The control system further can control and coordinate operation of a gauge part assembly to control selective formation of loops and/or tufts of yarns, and the lengths or pile heights thereof, at least with the yarn feed according to the instructions for the pattern being formed.

In addition, in embodiments, the gauge part assembly generally will comprise a series of gauge parts, including, for example and without limitation, loopers, hooks, level cut loop loopers, cut/loop clips, etc., provided below the tufting zone, and which will be moveable in a first direction so as to be reciprocated into engagement with the needles as the needles penetrate the backing material to pick loops of yarns therefrom. In some embodiments, the gauge parts further each can be selectively movable in a direction that is generally normal to their direction of reciprocation, for example, being moved in a substantially vertical, i.e., up-and-down, motion with respect to the stroke or reciprocation of the needles onto and out of the backing, as well as being moved in a reciprocating motion toward and away from the needles, to selectively pick up and form loops of yarns in the backing material. In addition, the vertical movement of the gauge parts can be controlled so as to form varying loops of yarns of varying pile heights in the backing material, including formation of different pile height loops or even no loops of yarns in the backing. In still further embodiments, other configurations and/or combinations of loop pile loopers, cut pile hooks, cut/loop hooks, level cut loopers or hooks, and/or other gauge parts also can be used.

For example, in some embodiment, the gauge parts can include loopers or hooks, each with a body slidably mounted within a gauge module or gauge block, and having a first portion and a second portion, which can include an elongated throat terminating at a pointed proximal end or bill. The first portion of the body can extend through the gauge block or module and can be connected at a distal end to an actuator. In some embodiments, the gauge modules each can include a module or block body having a first of rearward section adapted to couple or mount along a gauge bar, and a second or forward section having at least one channel or passage formed therethrough, and through which the gauge parts will be received. The modules further can include replaceable inserts that can be received within the passage or channel formed within the module body, the replaceable inserts further including slots or recesses adapted to receive and guide the gauge parts during movement of the gauge parts through/along the passage of the module block. Alternatively, the inserts could be integrated with the modules, such as by being bonded or otherwise substantially permanently affixed or secured to the bodies of their modules or gauge blocks, and in some embodiments, can be substantially affixed while still enabling at least serviceable removal thereof if needed.

In embodiments, the replaceable inserts will be formed from hardened materials that can include, without limitation, various metal carbides, metals, ceramics and/or synthetic materials, while the body of the module can be manufactured from lighter weight materials such as aluminum and/or other metals, as well as various composites or synthetic materials. The inserts further can include openings or slots configured to receive guide pins or other locating devices, as well as one or more fasteners, for securing the inserts in the gauge modules. The openings further generally will be configured to enable adjustment of the inserts in at least one direction, e.g., longitudinally, and/or in multiple directions e.g., longitudinally and/or laterally, for adjusting a position of the inserts, and thus the arrangement or positioning of the gauge parts across and/or along their gauge modules. The inserts further can be interchangeable so as to enable easy removal of the inserts, and thus the replacement of one or more of the gauge parts received therein, for example to replace a worn or broken gauge part, or for changing a spacing between the gauge parts.

As a further alternative, in some embodiments, the modules or gauge blocks themselves can be removed and can be replaceable with other gauge blocks or modules, each including a set or series of gauge parts mounted therein, such as to provide for a change out of gauge spacing between gauge parts, a change out of the type of size gauge parts being used, or for a replacement of substantially all or at least a large portion of worn or broken gauge parts as a unit. In addition, the guide slots or recesses formed within the inserts generally will be configured to receive the bodies of the gauge parts with a clearance that is generally sufficient to enable substantially free sliding movement of the gauge parts therethrough, but without enabling undue shifting or twisting of the gauge parts so as to create a misalignment of the bills or throats of the gauge parts with their respective needles. The slots or recesses of the inserts further can terminate at a rear end or portion that can be configured or adapted to enable the edges of the bodies of the gauge parts to be seated against and/or provided with a base or engagement area along which they can slide so as to help maintain a desired alignment of the gauge parts as they are reciprocated or moved through their modules.

The gauge parts additionally can be arranged so as to engage the needles, including being arranged in a substantially in-line, offset or staggered, and/or other configurations as needed to engage in-line, staggered and/or dual needle bar arrangements. In embodiments, each of the gauge parts further can be arranged at an angle with respect to the needles as the needles penetrate the backing. For example, in some embodiments, the gauge parts can be arranged and/or be extensible/retractable along a path of travel oriented at an angle that can range from approximately 1° to approximately 10° from the vertical with respect to the needles and/or the stroke or vertical motion thereof, while in other arrangements, no offset, i.e., a 0° angle, can be provided. The offset of the gauge parts with respect to the needles further can be varied so that the gauge parts can be extended and retracted along an angled or offset path of travel with respect to the needles as needed to minimize potential engagement with the needles as the gauge parts are moved, depending upon the spacing and/or arrangement of the needles.

In various embodiments, the actuators driving movement of the gauge parts can comprise hydraulic, electric, air or pneumatic cylinders, motors, or other, similar actuators. The actuators of each of the gauge parts can be selectively controlled in accordance with pattern instructions so as to cause the gauge parts to be moved to a desired vertical position with respect to associated needles for pickup of loops of yarns from the needles, including picking up loops of yarns at different points of the needles' stroke so as to form loops/tufts of different pile heights, as well as being retracted to a "no-sew" position wherein a loop of yarn generally will not be picked up. In further embodiments, the actuators can be controlled/triggered to move their gauge parts with a loop of yarn captured thereon so as to elongate or pull such captured loop(s) to provide other pile heights and/or other effects, such as for tip shearing or other pattern or textured effects.

In various aspects, the gauge parts further can be coupled to their respective actuators by connectors or gates configured to extend between an actuator shaft or rod and the distal end of an associated or corresponding gauge part. In some embodiments, the connectors or gates can include an arm or linkage having a first end portion configured to engage or connect to the drive rod of its actuator, an intermediate section projecting from the first end portion, and a second end portion that generally will be configured to engage the distal end of an associated gauge part. As each actuator is activated or deactivated, it extends or retracts its actuator shaft so as to cause its associated gauge part to move in a desired direction with respect to the needles.

For example, in some embodiments, the actuators can drive the gauge parts in a substantially vertical direction with respect to a directional reciprocation of the needles into and out of the backing, such as for adjusting a height of the gauge parts with respect to the needles as the gauge parts are reciprocated toward and away from the needles. In other embodiments, the actuation of the actuators and movement of the connectors can help control movement of the gauge parts toward and away from the needles, in a direction substantially along directional reciprocation of the gauge parts toward and away from the needles.

In addition, in embodiments, the linkage or arm of the connectors or gates further can be received within a housing or support structure. In one example embodiment, such a housing or support structure can include a body formed from a durable, lightweight material, such as a carbon filled nylon material or other, similar composite or plastic material selected to provide durability and support for the linkage or arm while enabling a reduction in weight. Other materials including various metals, synthetic and/or composite materials also can be used. The configurations of the support structure or housing further can be varied as needed to accommodate linkages of varying configurations and/or sizes; while in various embodiments, the connector linkages or arms further can have a reduced thickness or structure to further help reduce weight, and in some embodiments, can include a skeletonized structure. The connector linkages or arms are received within and move through channels or passages formed in the connector housings as the actuators are engaged and disengaged, translating this movement to their associated or corresponding gauge parts.

In some aspects of the present disclosure, a tufting machine is provided, comprising at least one needle bar having needles mounted therealong; backing feed rolls feeding a backing material the inserts each having a series of slots in which one of the gauge parts is slidably received; at least one yarn feed mechanism feeding yarns to the needles; and a gauge part assembly positioned below the backing material.

In some embodiments, the gauge part assembly can comprise at least one module carrying a series of gauge parts in a reciprocating motion in a direction toward and away from engagement with the needles as the needles are reciprocated into the backing material, wherein the at least one module comprises a module body that can be cast, molded or otherwise formed from a metal, polymer, composite or synthetic material, or combinations thereof, and will have a first hardness. The module body will be adapted to mount along a gauge bar and will be configured with a passage defined therethrough. Inserts will be mounted to the module body on opposite sides of the passage, each insert having a series of spaced slots formed therein, the slots each configured to slidably receive at least a portion of one of the gauge parts therein. In embodiments, the inserts can be cast, molded or otherwise formed from a metal or metal carbide or powdered metal material having a hardness greater than the hardness of module body, and with the slots formed or defined therein. In embodiments, the gauge parts can each include a body at least partially received within opposed slots of the inserts and moveable through the passage of the module body in an additional direction with respect to a stroke of the needles, the body of each gauge part having a first portion extending through the passage of the at least one module and a second portion having a throat configured to pick-up loops of yarns from the needles.

In embodiments, the tufting machine will include a series of actuators coupled to the gauge parts for controlling movement of the gauge parts though the module body; and a control system including programming for controlling the at least one yarn feed mechanism to control feeding of the yarns to the needles in coordination with control of the actuation of one or more of the actuators so as to extend or retract selected ones of the gauge parts such that the throats of the selected ones of gauge parts are moved between a no-sew position and an engaging position with respect to the stroke of the needles into the backing material for selectively forming tufts of yarns in the backing material according to a pattern being formed.

In various embodiments of the tufting machine, the gauge parts comprise level cut loop loopers, loop pile loopers, cut pile hooks, or cut/loop clips, and/or combinations thereof. In still further embodiments of the tufting machine, the actuators can comprise hydraulic or pneumatic cylinders, servomotors, or other types of actuators.

In still other embodiments of the tufting machine, the gauge part assembly further can comprise a series of connectors extending between each gauge part and an associated actuator, each of the connectors including a linkage received within and movable through a housing.

In some embodiments, the housing of each connector will comprise a body that can be formed from a polymer, composite or synthetic material or combination thereof and having a channel extending there through; and wherein each linkage comprises a metal or composite material or combinations thereof.

In other embodiments, the body of each housing can comprise a composite material including a polymer or plastic with a fibrous fill material, and has a channel defined therein and along which the linkage is moveable; and wherein the linkage of each connector comprises a hardened metal body coupled to the body of the housing and having a proximal end configured to engage the first portion of one of the gauge parts, and a distal end configured to be engaged by the actuator associated with the gauge part for translating movement by the actuator to the gauge part.

In still further embodiments, the inserts of the at least one module each comprise a first insert and a second insert, each including a tab or flange portion that will overlie and/or mount to a top or first or a bottom or second surface of the module body. In other embodiments, the body of each insert can have an upper or proximal portion, a lower or distal portion, and an intermediate section extending therebetween and extending along the passage defined through the module body; with the slots of the first or left insert spaced from and opposing and substantially aligned with corresponding slots of the second or right insert.

In addition, in embodiments, the tab or flange portions of each of the first and second inserts are configured to overlap an upper surface of the module body and includes a slotted opening adapted to receive a fastener therethrough for adjustably mounting each of the first and second inserts to the module body with the inserts arranged at a selected spacing from each other and at a selected location with respect to the passage defined through the module body. In addition, the inserts can be molded or encased, encapsulated, or otherwise substantially integrated within the module body. The inserts also can include tabs or flange portions that can engage opposite side surfaces of the module body; and a plate or intermediate section can be provided therebetween. The intermediate section can connect the tabs or flanges of the inserts, with the slots of the inserts at least partially formed therein and extending therealong. Alternatively, a bearing plate of support can be received along the first and second side surfaces of the passage, between the tabs or flanges of the inserts.

Thus, in some aspects of the present disclosure, a gauge part assembly for a tufting machine, comprising at least one module having a module body with a passage defined therethrough; and a series of gauge parts received within the passage of the module body, each gauge part including a body with a first portion and a second portion having a throat, wherein the gauge parts are carried with their modules in a first direction toward and away from engagement with associated needles of the tufting machine to pick up loops of yarns from the needles along the throats of the gauge parts, and wherein the gauge parts are selectively movable in a second direction along the passage of the module body. The first and second inserts arranged along opposite sides of the passage of the module body, each insert formed from material having a hardness greater than a hardness of the metal or composite material of the module body and having a series of spaced slots configured to receive at least a portion of one of the gauge parts therealong; wherein the slots of the first and second inserts are substantially aligned across the passage; and a plurality of actuators each actuator coupled to the first portion of an associated gauge part of the series of the gauge parts and adapted to move their associated gauge parts in the second direction through the passage of the at least one module, whereby the gauge parts are extended or retracted through the module body so as to move the throats of the gauge parts between extended positions for engaging and picking loops of yarns from the needles and a retracted position to substantially avoid picking loops of yarns from the needles.

In embodiments, the gauge part assembly can further comprise a connector extending between each actuator and its associated gauge part, each connector having a housing formed from a polymer material with a linkage encased therein. In some embodiments, the module body of the at least one module is molded or cast from a metal or composite material.

In still other embodiments, the gauge part assembly can include first and second inserts that each comprise a body molded or cast from a metal, carbide or powdered metal material and including a tab or flange portion in which the slots are formed. Still further, the body of each of the first and second inserts further comprises upper and lower tab or flange portions engaging upper and lower surfaces of the module body, with the slots extending through the upper and lower tab or flange portions.

In additional embodiments, the gauge part assembly can include first and second inserts that each comprise a body molded or cast from a metal, carbide or powdered metal material and including a tab or flange portion in which the slots are formed, and wherein the module body of the at least one module comprises a metal or composite material molded or cast to form the module body with the first and second inserts substantially integrated therewith.

In some aspects of the present disclosure, a method of operating a tufting machine is disclosed, wherein, according to one example embodiment of the present disclosure, as the needles of the tufting machine are reciprocated into and out of the backing, the actuators of the gauge parts can be selectively engaged or disengaged so as to move their gauge parts between a fully retracted or no-sew position at which gauge parts will not engage an associated or corresponding needle, and thus no loop of yarn will be formed thereby, and varying extended or raised positions, including a fully extended position. In their raised or extended positions, the gauge parts engage the needles at the take-off portions thereof, as the needles pass into and out of the backing material, to pick-up loops of yarns from the needles. The loops of yarns picked up from the needles can have varying pile heights or lengths depending upon the position and/or movement of the gauge parts with respect to their associated or corresponding needles. For example, in a fully raised position, a smaller or decreased length loop of yarn can be formed for creating a lower pile height, or even substantially hidden loops of yarns in the backing, including such loops being substantially removed by control of the yarn feed thereof. Longer loops of yarns can be picked up and formed by loopers as the loopers are moved to lowered positions, pulling the loops of yarns therewith, as needed, so as to create higher or greater pile height tufts of yarns in the backing. In addition, the actuators further can be controlled to selectively cause their corresponding gauge parts to be lowered or retracted with a loop of yarn captured thereon, to form still longer loops of yarns to enable additional patterning effects, such as for tip shearing and the like.

The needles further generally can be shifted laterally with respect to the longitudinal movement of the backing through the tufting zone in order to present different color or different type yarns to each stitch location of the pattern being formed in the backing material. For example, the needles of the needle bar or bars can be threaded with a series of desired colors in various thread-up sequences. In addition, the backing material typically can be run at an actual or effective stitch rate that is substantially greater than the prescribed or desired pattern stitch rate for the pattern being formed. As a result, as the needles are shifted, a desired number of different color or type yarns can be presented to each stitch location. By control of the positioning and/or movement of the gauge parts, loops of yarns can be selectively formed in the backing material, and with the formation of such loops of yarns further being controllable for forming varying pile heights of the resultant tufts in some embodiments. For example, in various aspects, a series of different color or type yarns can be presented to each stitch location as the needle bars are shifted, and if a tuft of a particular color or type yarn is not selected to be sewn at that stitch location, the corresponding gauge part can be held in a retracted or lowered position such that the loop of such a non-selected yarn generally will not be formed.

In addition, as the needles are reciprocated out of the backing, the yarn feed therefor also can be controlled so as to cause non-selected yarns to be retracted, back-robbed or otherwise pulled back or out of the backing material with the needles, and to retract, back-rob or pull back some loops of yarns to an extent sufficient to prevent such yarn from being shown at that stitch location in the finished patterned article. The control of the backing material at the higher operative, effective or actual stitch rate enables the formation of a substantially increased number of stitches of presentations of yarns into the backing material so as to substantially avoid a missing color or type of yarn or gap being created, shown or otherwise appearing in the pattern fields of the patterned tufted article. The finished patterned tufted article thus can be provided with a density of tufts per inch that substantially matches a desired or prescribed pattern stitch rate, i.e., for patterns designed with a pattern stitch rate of 8, 10 or 12, or other numbers of stitches per inch, the resultant finished patterned tufted article can be formed a density of visible and/or retained face yarns or tufts per inch that can approximately match the pattern stitch rate.

The foregoing and other advantages and aspects of the embodiments of the present disclosure will become apparent and more readily appreciated from the following detailed description and the claims, taken in conjunction with the accompanying drawings. Moreover, it is to be understood that both the foregoing summary of the disclosure and the following detailed description are exemplary and intended to provide further explanation without limiting the scope of the present disclosure.

BRIEF DESCRIPTION OF THE DRAWINGS

The accompanying drawings, which are included to provide a further understanding of the embodiments of the present disclosure, are incorporated in and constitute a part of this specification, illustrate embodiments of this disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced. Those skilled in the art further will appreciate and understand that, according to common practice, the various features of the drawings discussed below are not necessarily drawn to scale, and that the dimensions of various features and elements of the drawings may be expanded or reduced to more clearly illustrate the embodiments of the present disclosure described herein.

DETAILED DESCRIPTION

Figure 1:
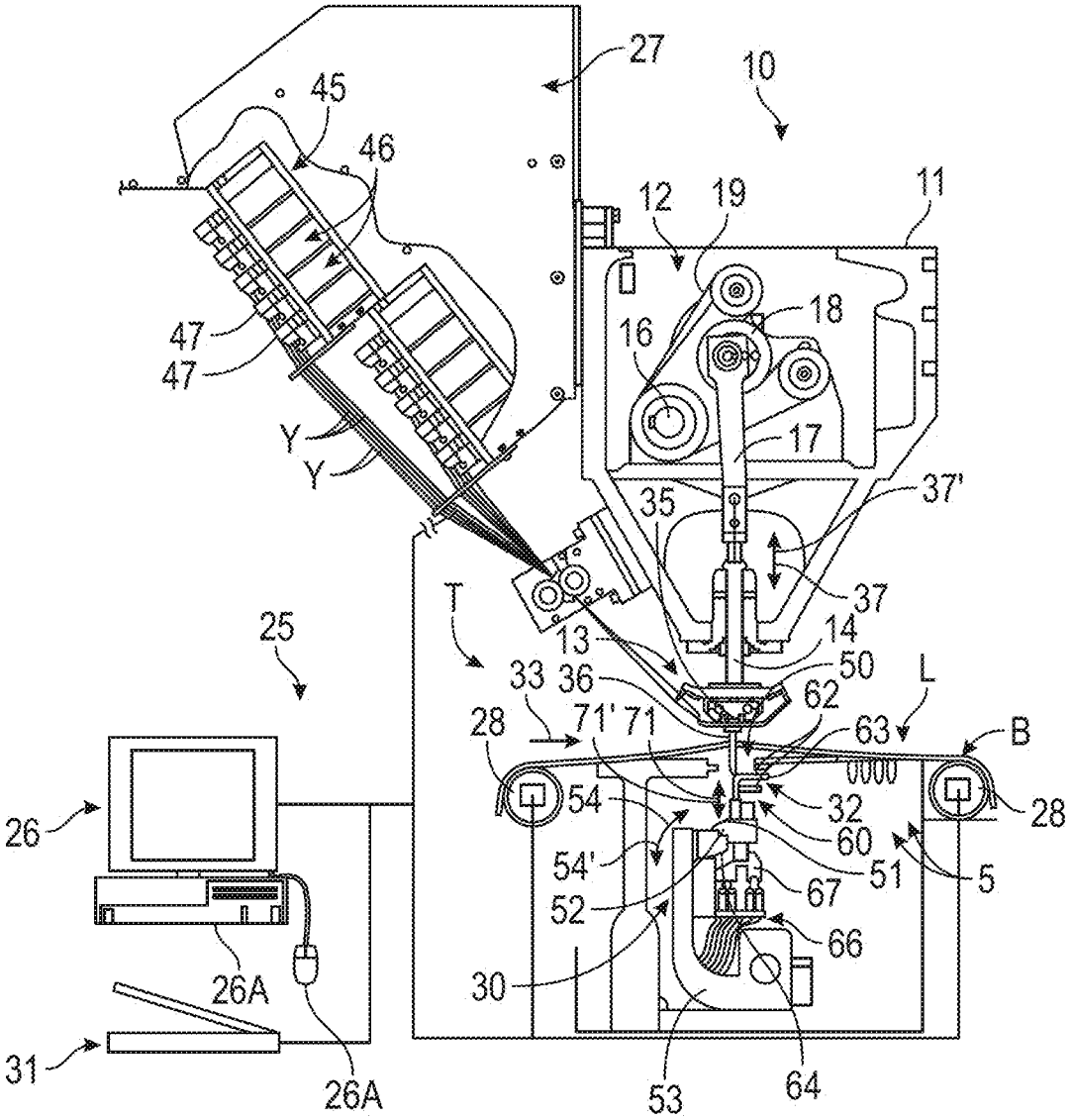
FIG. 1 is a side elevational view of one example embodiment of a tufting machine with selectively controllable looper assembly according to the principles of the present disclosure.

Referring now to the drawings in which like numerals indicate like parts throughout the several views, FIGS. 1-11C generally illustrate an embodiment of a tufting machine 10 and method for forming patterned tufted articles, according to the principles of the present disclosure, wherein placement of stitches or tufts 5 of yarns Y can be at desired locations in a backing material B can be controlled. Such tufts or stitches can be formed with a sculptured, multi-pile height tufted appearance, and further can be placed with enhanced selectivity and/or control, for formation of further varying or free-flowing pattern effects. For example, the tufted article can be formed with the tufts of yarns formed at varying pile heights to provide sculptured looks, and with different color or type yarns for formation of multi-color patterns of various geometric and/or free-flowing designs. Additionally, it will be understood that various numbers of different type and/or color yarns (i.e., two color, three color, five color, six color, etc.), can be used to form multiple pile height patterned tufted articles according to the principles of the present disclosure.

As generally illustrated in FIG. 1, in one embodiment, the tufting machine 10 will include a frame 11, which can include a head or upper portion 12 housing a needle bar drive 13 and defining a tufting zone T. The needle bar drive mechanism 13 (FIGS. 1 and 2) typically includes a series of push rods 14 that can be connected to a needle bar drive 16 (such as a gear box/assembly) shown in FIG. 1 or similar mechanism, by connector rods 17, which needle bar drive 16 in turn can be connected to and driven off a main drive shaft 18 of the tufting machine, for example by one or more drive belts or drive chains 19, and with the main drive shaft 18 itself being driven by a motor such as a servo motor. Alternatively, the push rods 14 of the needle bar drive mechanism 13 can be connected via connector rods 17 to the main drive shaft 18 so as to be driven directly off the main drive shaft, or by an independent drive system (not shown).

An encoder or similar sensor additionally can be provided for monitoring the rotation of the main drive shaft and reporting the position of the main drive shaft to a control system 25 (FIG. 1) controlling the operation of the tufting machine 10. The control system 25 generally can comprise a tufting machine control including a computer/processor or system controller 26 with an operator interface 26A, such as a touch screen, keyboard, mouse, etc., through which the operator can input patterns, make adjustments, etc. In some embodiments, the control system 25 can comprise or include a stitch distribution control system such as disclosed in U.S. Pat. No. 8,359,989, the disclosure of which is incorporated by reference as if set forth fully herein, with the controller 26 further including programming for control methodology for forming tufted patterns, including sculptured patterns having tufts formed at multiple pile heights, as well as with various color/stitch placement controlled patterns such as disclosed in U.S. Pat. No. 8,359,989.

Figure 2:
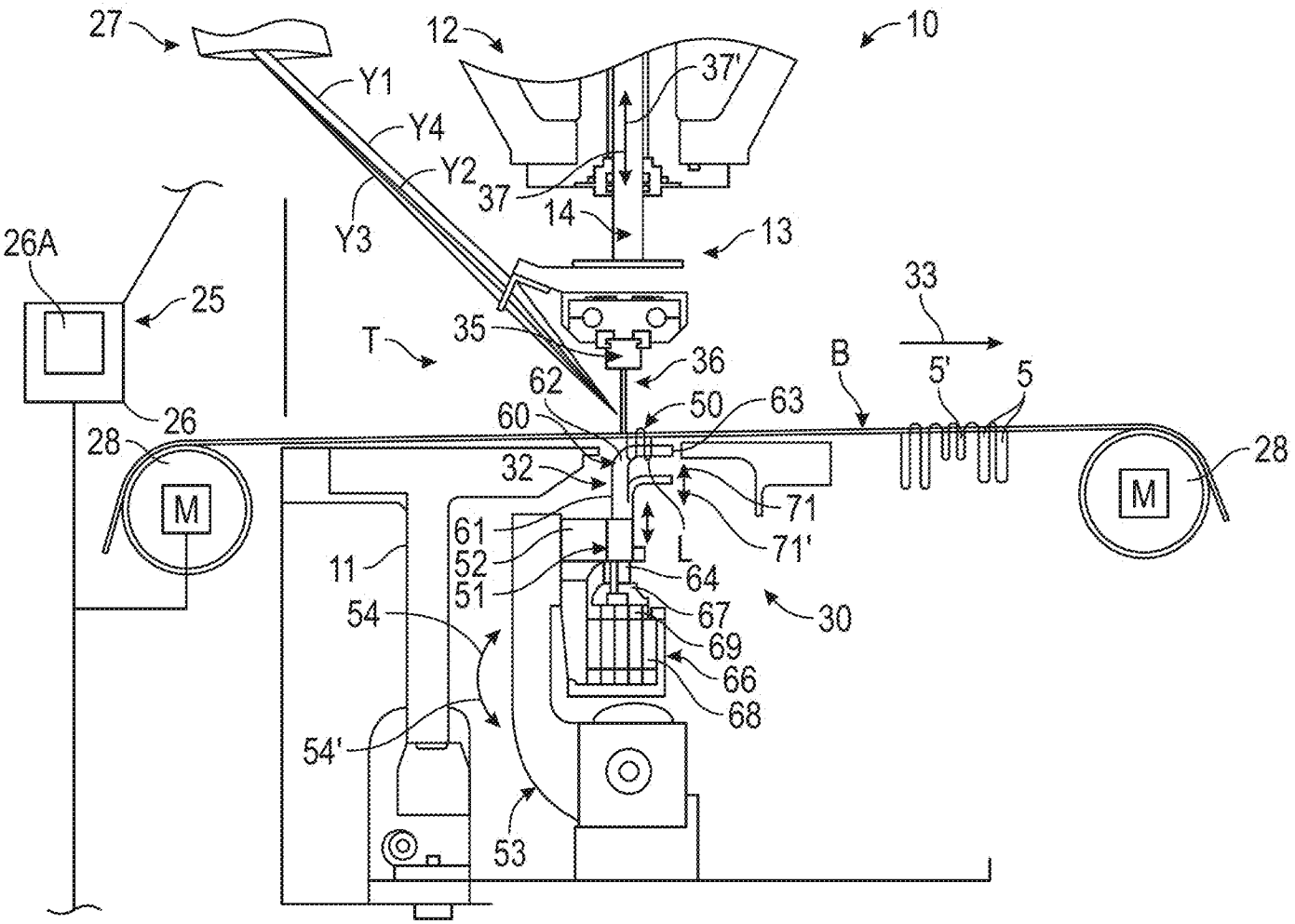
FIG. 2 is a side elevational view of the tufting zone of the tufting machine of FIG. 1.
Figure 3:
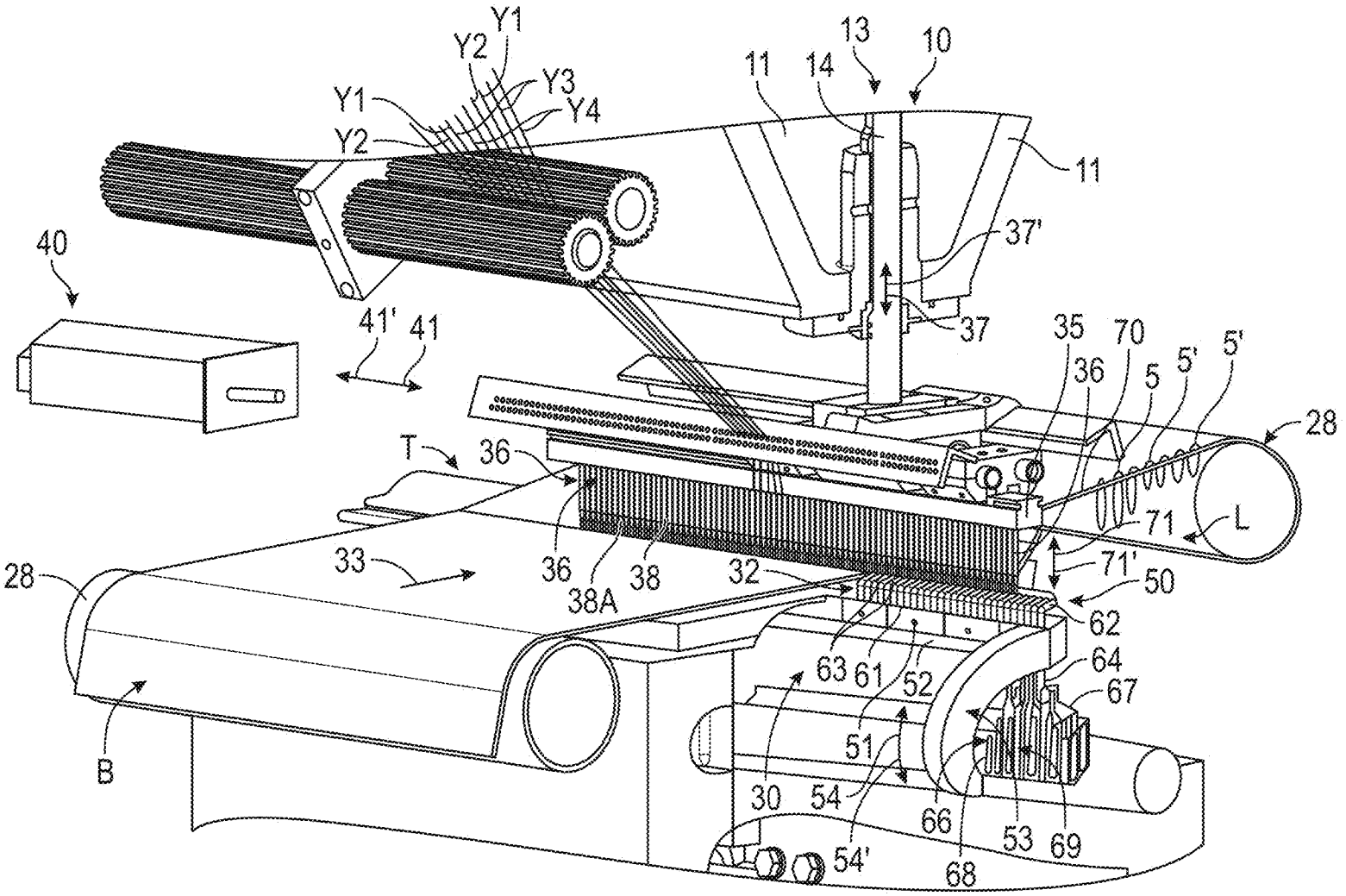
FIG. 3 is a perspective view of the tufting machine of FIGS. 1-2.

The control system 25 generally will include programming enabling the monitoring and control of the operative elements of the tufting machine 10, such as the needle bar drive mechanism 13, yarn feed attachments 27, backing feed rolls 28, the main drive shaft 18, a needle bar shift mechanism 40 (FIG. 3) and a gauge part assembly 30 mounted beneath the tufting zone T of the tufting machine in accordance with the calculated/determined pattern instructions, as discussed more fully below. The control system 25 (FIG. 1) further can receive and execute or store pattern information in memory storage of the system controller 26. In response to developed/programmed pattern instructions, the control system 25 will control the operative elements of the tufting machine 10 in order to form the desired tufted patterns in the backing material B as the backing material is passed through the tufting zone T in the direction of arrow 33 by the backing feed rolls 28, as indicated in FIGS. 1-3.

In some embodiments, the system controller 26 of the control system 25 generally can be programmed with instructions for forming one or more desired patterns for one or more tufted articles, including a series of pattern steps, which steps can be created or calculated manually or through the use of design centers or design software as understood by those skilled in the art or can receive such patterns via input from a disk, USB or other external drive, or through a network connection. Alternatively, the controller 26 can include image recognition software to enable scanned and/or designed pattern images, such as designed patterns, including pile heights and other characteristics such as placement of loop pile and cut pile tufts in the pattern shown by, for example, different colors or similar markers or indicators, as well as photographs, drawings and other images, can be input, programmed, recognized and processed by the control system, including receiving inputs from a design center or through various design software systems, or via a scanner or other imaging device 31 (FIG. 1). The control system can recognize and identify various pattern characteristics, including colors and/or difference in texture of a designed pattern image indicative of texture effects such as placement or location of loop and/or cut pile tufts, and can assign selected yarns thereto.

Additionally, in embodiments such as where the control system 25 can operate in conjunction with or also can comprise or include a stitch distribution control system, as disclosed in U.S. Pat. No. 8,359,989 (incorporated by reference as if set forth fully herein). For example, and without limitation, the control system can incorporate programming to provide for the functionality of such a stitch distribution control system, or a separate stitch distribution control can be linked thereto. The control system also can be provided with software/programming to enable reading and recognition of colors of an input scanned pattern, and can assign supply positions for the yarns being supplied from a supply creel to various ones of the needles based on the thread-up sequence of the needles of the needle bar so as to optimize the supplies of the various color yarns in the creel for the best use thereof, to form recognized pattern fields from pattern images. The control system further can include programming enabling it to create pattern fields or mapping of the pattern, including mapping a series of pattern pixels or tuft/stitch placement locations identifying the spaces or locations at which the various color yarns and/or cut/loop pile tufts will be selectively placed to form the imaged pattern. A desired pattern density, i.e., a desired number of stitches per inch to appear on the face of the finished patterned tufted article, also can be selected and an actual effective or operative process stitch rate for the pattern calculated to achieve the appearance of the desired fabric stitch rate of the pattern.

The control system 25 of the present disclosure further can include programming to receive, determine and/or execute various shift or cam profiles, or can calculate a proposed shift profile based on a scanned, an input, or other designed pattern image or pattern file. For example, in one non-limiting embodiment, a designed pattern file image, photograph, drawing, etc., can be loaded, scanned, or otherwise input at the tufting machine or by a network connection, and the control system can read, recognize and calculate the pattern steps/parameters, including control of yarn feed, control of backing movement and/or needle reciprocation to form tufts in the backing at an effective stitch rate to achieve a desired pattern density, a cam/shift profile, and arrangement of yarns to match the scanned and/or designed pattern image, and can thereafter control the operation of the tufting machine to form this selected pattern. An operator additionally can select or modify stitch rates, yarn feeds, a selected cam profile or a calculated shift profile, such as by indicating whether the pattern is to have 2, 3, 4, 5, 6 or more colors, or a desired number of pattern repeats, and/or can manually calculate, input and/or adjust or change the creel assignments, shift profiles and/or a color mapping created by the control system as needed via a manual override control/programming.

As indicated in FIGS. 1-3, the tufting machine 10 further will include one or more needle bars 35 attached to and driven by the push rods 14. The needle bar(s) 35 move a series of needles 36 in a reciprocating motion (shown by arrows 37/37') into and out of the backing material B, so as to carry or insert the yarns Y into the backing. In some embodiments, the needles can be arranged in a single in-line row along one or two needle bars. In other embodiments, the needles 36 can be mounted in a staggered arrangement along a single needle bar or along a pair of needle bars, with offset rows of needles spaced transversely along the length of each needle bar(s) and being staggered across the tufting zone of the tufting machine. The needle bar(s) 35 further can be shiftable transversely across the width of the backing material, so as to shift or step the needles 36 in a direction that is transverse or generally perpendicular to the longitudinal path of travel of the backing material through the tufting machine.

Accordingly, while one example embodiment including a single needle bar 35, with an inline row of needles 36 arranged therealong may be shown in the figures, the present disclosure is not limited to the use of a single needle bar or a particular configuration of needles. Instead, it will be understood by those skilled in the art that additional arrangements of dual needle bars and single needle bars having spaced rows of needles 36 that can be arranged in-line or in staggered or offset configurations, and both of which further can be shifted, also can be utilized in the tufting machine 10 incorporating the system according to the present disclosure.

Figure 10A:
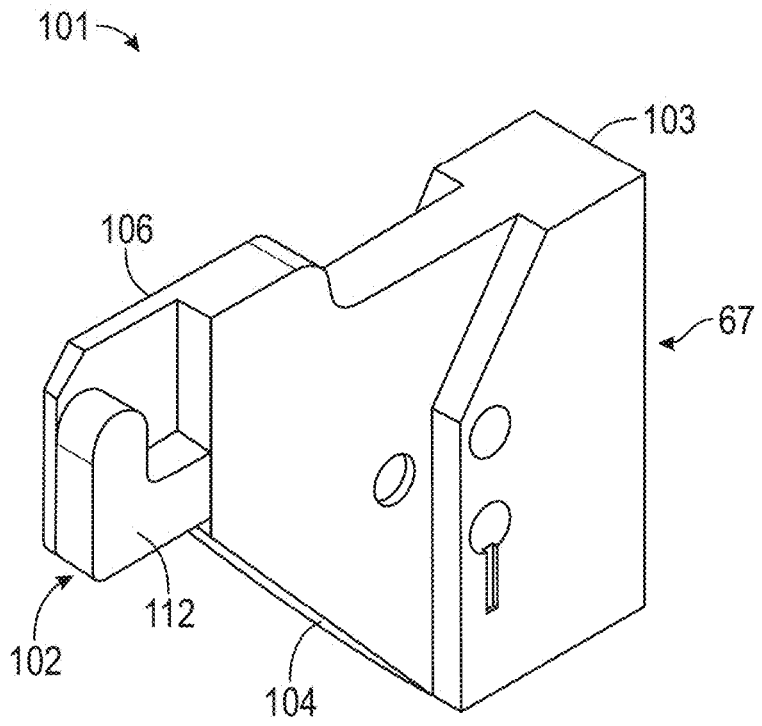
FIGS. 10A-10B illustrate still a further an embodiment of a connector for connecting the gauge parts to their actuators according to principles of the present disclosure.
Figure 10B:
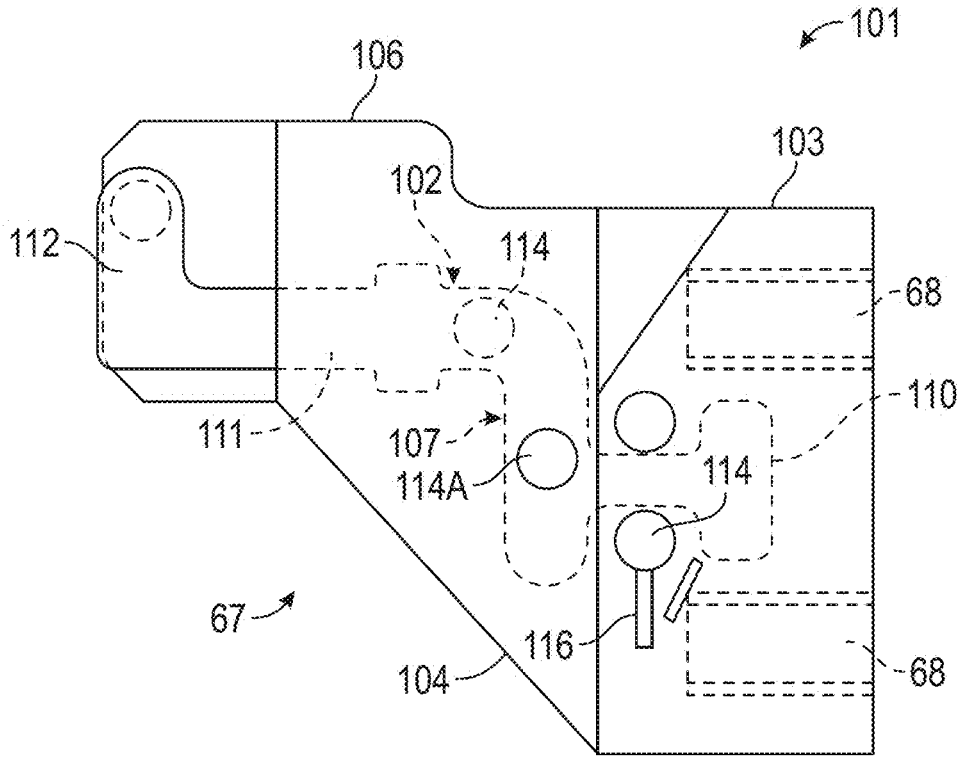
Figure 11A:
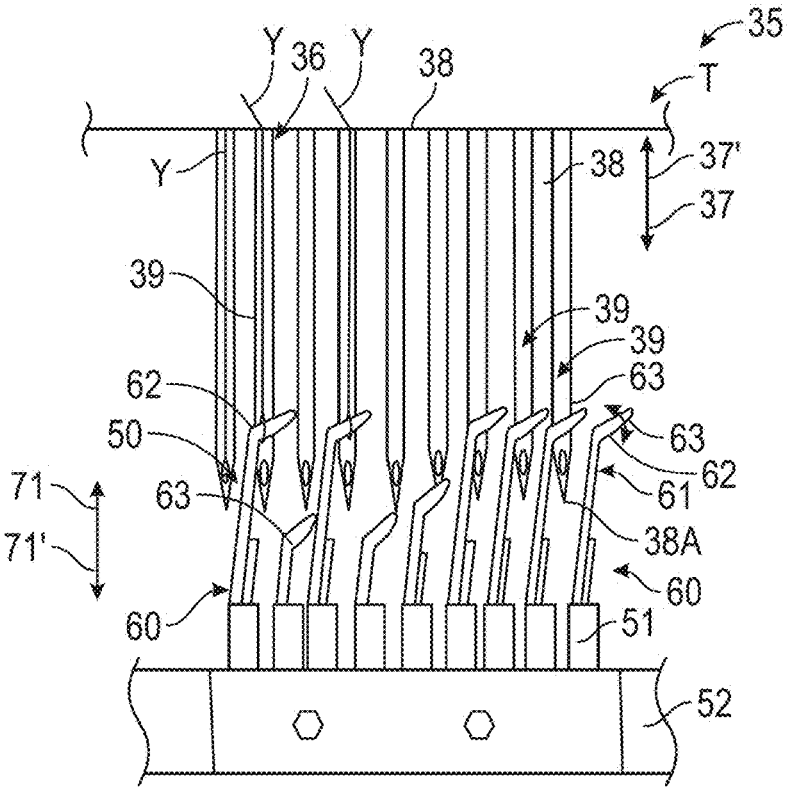
FIGS. 11A-11B are perspective views of a portion of a series of needles and their respective gauge parts in one example embodiment in accordance with the principles of the present disclosure.

Each of the needles generally will include a shank or body 38 terminating at a pointed end 38A, and including a take-off point or area 39 where the gauge parts 32 can engage and pick-up yarns Y from the needles, such as indicated in FIGS. 10A-11A. As the needles are reciprocated in substantially vertical motion in the direction of arrows 37 and 37' (FIG. 2), they penetrate into and out of the backing material B along a stroke to a desired or predetermined penetration depth, carrying the yarns Y therewith, and will be selectively engaged by gauge parts 32 of the gauge part assembly 30, as shown in FIGS. 11A-11C to pick up loops L of the yarns from the needles. Additionally, as illustrated in FIG. 3, a shift mechanism 40 also can be linked to the needle bar 35 (or needle bars) where used for shifting the needle bar in the direction of arrows 41 and 41', transversely across the tufting zone according to calculated or computed pattern instructions. The shift mechanism 40 can include a Smart Step™ type shifter as manufactured by Card-Monroe Corp., or alternatively can include various other types of shift mechanisms including servo-motor or hydraulically controlled shifters, and/or pattern cam shifters as are conventionally used. Additional shift mechanisms including backing material or jute shifters, operable separately or in conjunction with a needle bar shifter for shifting the backing material laterally with respect to the needles also can be used.

As further illustrated in FIG. 1, one or more yarn feed mechanisms or attachments 27 can be mounted to the frame 11 of the tufting machine 10 for controlling the feeding of the yarns Y to each of the needles 36 during operation of the tufting machine. For example, as indicated in FIG. 3, a series of different type or color yarns (Y1-Y4) can be fed in a selected thread-up sequence or series (e.g., ABCD) to each of the needles, with the thread-up sequences generally being determined or selected based upon a pattern being run. Additionally, while one yarn feed unit 27 is shown along one side of the tufting machine 10 (for purposes of illustration), in other embodiments, multiple yarn feed units can be mounted on one or both sides of the tufting machine, for feeding yarns to the needles 36 of one or more needle bars 35.

There are a variety of yarn feed attachments that can be utilized with the stitch distribution control system of the present disclosure for controlling the feeding of the different yarns Y to various ones of the needles 36. The pattern yarn feed attachments or mechanisms 27 (FIG. 1) can comprise conventional yarn feed/drive mechanisms such as roll or scroll pattern attachments having a series of rolls extending at least partially along the tufting machine and driven by motors under direction of the control system 25 for controlling the feeding of the yarns across the tufting machine to form pattern repeats and/or multiple pile heights and/or other texture effects across the width of the backing material. Such yarn feed mechanisms or attachments can include Quick Thread™, Enhanced Graphics™, and/or Multi Pile Height Scroll yarn feed controls/attachments as manufactured by Card-Monroe Corp.

In some embodiments, pattern yarn feed attachments can be used which have multiple yarn feed drives 45, as indicated in FIG. 1, each including a motor 46 and a feed roll 47, for controlling the feeding of specific sets of repeats of yarns to selected needles, including the use of individual yarn feed rolls or drives 45 for controlling the feeding of single yarns (or ends) or multiple ends of yarns (i.e., 2-4 or more yarns) to the needles 36, such as single and multi-end/servo-scroll attachments, including Infinity™ and Infinity IIE™ systems as manufactured by Card-Monroe Corp. Thus, while in FIG. 1 a yarn feed such as a single or multiple end type yarn feed mechanism 27 is shown, it will be understood by those skilled in the art that the pattern yarn feed mechanisms utilized to control the yarn feed can include single or double end yarn feed controls, scroll, roll, and/or similar attachments, and/or various combinations thereof, and further can be mounted along one or both sides of the tufting machine. Still further, in embodiments, the control system 25 can perform yarn feed compensation and/or yarn feed modeling to help control and reduce or minimize the amounts of non-retained/non-appearing yarns to be fed to avoid excess feeding of yarns and thus minimize waste during a tufting operation.

The yarn feed attachment can be controlled to selectively feed the yarns to their respective needles in cooperation with the other operative systems of the tufting machine, including the backing feed, shifting of the needle bars and the operation of the gauge part assembly 30, to enable control of the presentation of a number of different colors or types of yarns into the packing and the selective pick-up and retention of loops of selected or desired ones of the presented yarns (e.g., yarns selected to appear in the face of the finished patterned article) to form tufts of such yarns with selected or desired pile heights. In addition, the surface or face yarns or tufts that are to appear on the face of the tufted article can be controlled so as to be fed in amounts sufficient to form such tufts of the selected color or type yarns at desired or prescribed pile heights, while the non-appearing yarns that are to be hidden in particular color and/or texture fields of the pattern will be back-robbed and/or pulled substantially low or out of the backing material to an extent sufficient to avoid such yarns interfering with the face yarns or retained tufts that are to be visible in the pattern field, and to avoid creating an undesired space or gap between the retained tufts or face yarns.

In an embodiment, each color or type yarn that can be placed/tufted at each pixel or stitch location generally either can be presented to such pixel or stitch location for tufting, with only the yarn(s) selected to be shown or appearing at the pixel or stitch location being retained and formed at a desired pile height. Thus, for a 4 color pattern, for example, each of the 4 color yarns A, B, C and D that can be tufted at a particular pixel or location can be presented to such pixel with only the selected yarn or yarns of the pattern, e.g., the "A" yarn, being retained, while the remaining, non-selected yarns, B, B-C, B-D, and/or other combinations, can be presented and back-robbed/pulled back and/or removed from the backing at such pixels or stitch locations. Accordingly, when a yarn is presented to a pixel or stitch location, if the yarn is to be retained or appear in the pixel or stitch location, the yarn feed 27 can be controlled to feed an amount of yarn so as to form a tuft of yarn at the pixel or stitch location. If the yarn presented is not to be retained or appearing in the pixel or stitch location, it can be controlled so that a loop or tuft may not be formed, or can be pulled back and/or removed. If no yarns are selected for insertion at a particular pixel or stitch location, the gauge parts also can be controlled to selectively pick-up or not pick-up loops of yarns presented to particular pixels.

As further shown in FIGS. 1-3, the gauge part assembly 30 generally is mounted below the bed 34 and tufting zone T of the tufting machine 10. As the needles penetrate the backing material, they are engaged by a series of gauge parts 32 of the gauge part assembly 30 so as to form loops L (FIGS. 2-3) of the yarns Y for forming tufts 5 of yarns of selected colors or types, and with selected lengths or pile heights. The gauge parts 32 of the gauge part assembly 30, in various embodiments, can include a series of loopers or hooks 50, each of which can be slidably mounted within a gauge module, gauge block or other holder that can be mounted along a gauge bar 52 or similar mount or attachment for coupling the gauge parts to a drive mechanism 53 for driving a reciprocating movement of the gauge parts in a first direction toward and away from the needles 36, as indicated by arrows 54 and 54' in FIGS. 1-3. It further will be understood by those skilled in the art that various types of gauge parts, including cut pile hooks, loop pile loopers, level out loop loopers, cut/loop clips or other gauge parts also can be used.

Figure 5:
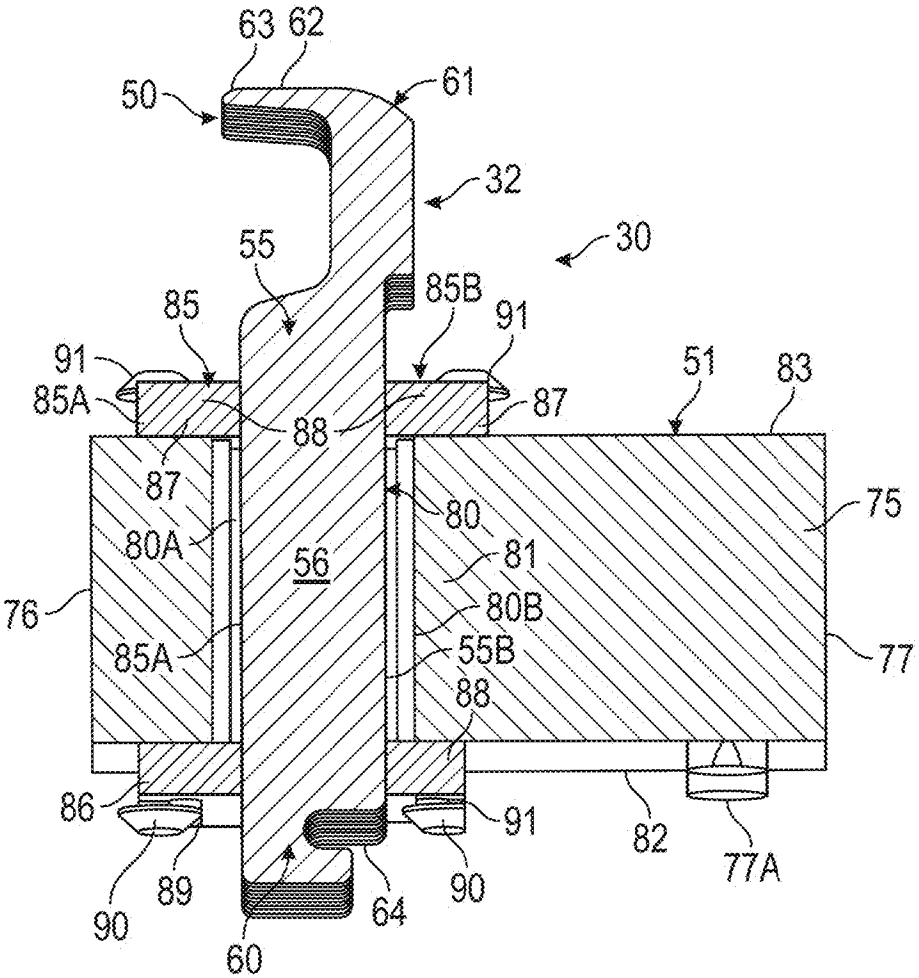
FIG. 5 is a cross-sectional view of the gauge module or gauge block and gauge parts of FIG. 4.
Figure 4:
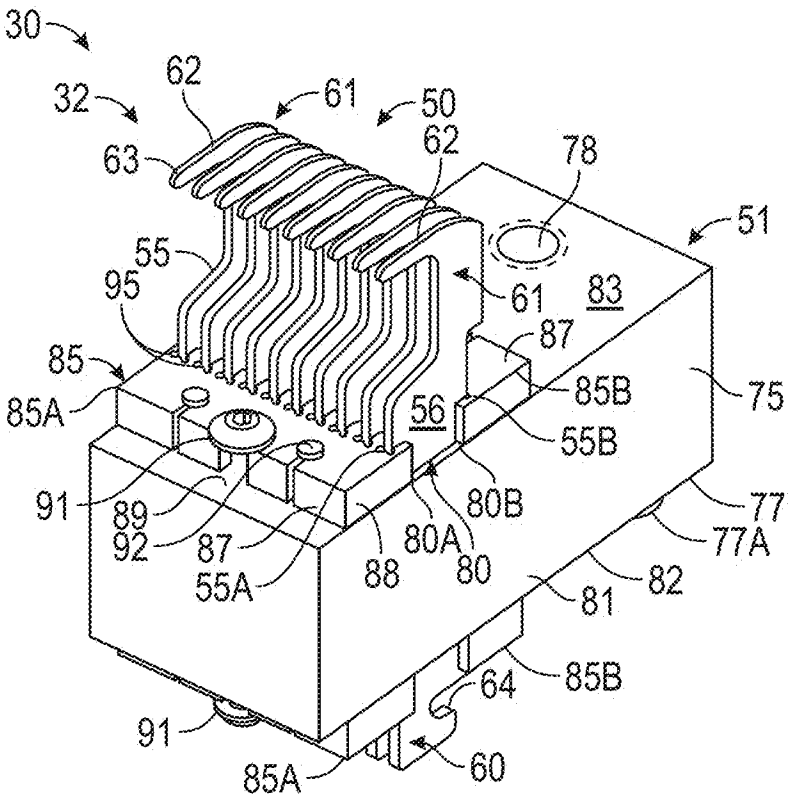
FIG. 4 is a perspective view of an example embodiment of a gauge module or gauge block and gauge parts according to principles of the present disclosure.

As indicated in FIGS. 4-5, in one embodiment, the gauge parts 32 can include loopers or hooks 50, each having an elongated body 55 that can be slidably mounted within and can be moveable through its gauge module 51. The body 55 of each looper or hook 50 will include a first portion 60, a second portion 61 including an elongated throat 62 that, in one embodiment as shown in FIGS. 4-5, generally can extend at an angle with respect to an intermediate portion 56 of the body 55, and which can terminate at a generally pointed proximal end or bill 63. For example, the throat 62 and proximal end 63 can be configured similar to a loop pile looper. Other configurations of gauge parts also can be used. As further indicated in FIGS. 4-5, the first portion 60 of the body of each looper or hook 50 generally will project through the gauge module or block 51, and can have a slot or recess 64 formed therein, by which the looper or hook can be engaged and/or coupled to an actuator 66, such as by a gate or connector 67 (FIG. 2).

FIGS. 4-5 illustrate one embodiment of a gauge module or gauge block 51, which includes a body 75, that can have a substantially rectangular or square configuration as shown, although other configurations also can be used, and in which a series or set of gauge parts 32, such as loopers or hooks 50 are received. In some embodiments, the module body 75 of each gauge module 51 will be formed from a metal or metal alloy material, although various composites, synthetic materials and/or other materials also can be used. For example, and without limitation, the body of the gauge module can be made from a lightweight steel, such as a mild steel or tool steel, or aluminum, or other, similar lightweight yet substantially rigid and durable materials. In embodiments, the module bodies can be cast, molded or otherwise formed. The material from which the body of the gauge module is formed further can be selected to provide a reduction of weight to the gauge modules, while still providing sufficient durability and rigidity to hold and/or substantially maintain the gauge parts in their alignment or position for engaging the take-off portions of the needles during reciprocation of the gauge parts into and away from engagement during operation of the tufting machine.

As generally illustrated in FIGS. 4-6B, the module body 75 of each gauge module 51 will include a first, forward or front section 76, and a second, rear or back section 77. The rear section 77 of the body 75 of each gauge module 51 further generally will be configured to engage and mount to a gauge bar, such as illustrated in FIG. 3. For example, the rear section of the body can include tabs or other locating devices 77A (FIG. 5) for aligning the gauge module along the gauge bar and further will include at least one fastener opening, such as shown at 78 in FIGS. 6A-6B, therealong. A removable fastener such as a socket, hex screw, or other, similar removable fastener or attachment device, will be inserted through the fastener opening 78 and into a corresponding opening 79 (FIG. 6B) in the gauge bar for releasably mounting the gauge module 51 to the gauge bar. As a result, in some embodiments, the gauge modules, with their gauge parts contained therein, can be removed and replaced as a unit, without necessarily having to replace individual gauge parts; for example, to expedite a change out of broken or damaged gauge parts, or for changing the gauge spacing or arrangement of the gauge parts of the tufting machine.

As further indicated in FIGS. 4-6B, a passage 80 generally will be formed through the body 75 of each gauge module 51, with the passage 80 generally located along an intermediate portion 81 of the body between the first and second sections 76/77 thereof. The passage 80 will be sized and/or configured to receive a plurality of gauge parts, such as loopers or hooks 50, therein. In embodiments such as illustrated in FIGS. 4-5, the body 55 of each of the loopers or hooks 50 generally will be received within and extend through the passage 80, with the first portions 60 of each of the loopers or hooks generally projecting downwardly past the lower or bottom surface 82 of the module body 75, while the second portion 61 of each looper or hook can extend/project upwardly from and above the upper or top surface 83 of the module body 75.

In addition, one or more inserts 85 can be mounted to the opposite side surfaces, e.g., the upper and lower surfaces, of each module body, in positions or locations aligned along the passage 80 defined through the whole body of each gauge module, as generally indicated in FIGS. 4-5. The inserts will be configured to engage and guide the gauge parts as the gauge parts are moved through and along the passage of the gauge module body. For example, in some embodiments, such as illustrated in FIGS. 4-6A, pairs or sets of inserts 85A and 85B can be provided, with one of the inserts (e.g. a first insert 85A) being mounted along a first, left or forward side 80A of the passage 80, while the insert (e.g., a second insert 85B) is mounted along a second, right or rearward side 80B of the passage 80, and with each of the inserts 85A and 85B generally being arranged in a substantially facing, opposed, parallel relationship with the gauge parts 32 engaged and moveable therebetween. Also, in some embodiments, such as indicated in FIGS. 4-5, a pair of first inserts can be mounted along the top and bottom surfaces of the module body along the 1st or left side of the passage, and a pair of second inserts 85B can be mounted along the top and bottom surfaces of the module body along the 2nd or right side of the passage.

Each of the inserts 85 generally will be formed from a hardened metal or metal alloy material, a metal carbide, ceramics, and/or powdered metal materials including metal powders including tungsten, titanium, or other materials having a hardness that is greater than the hardness of the material of the gauge module body. For example, in some embodiments, the inserts can be formed from a metal carbide material having a hardness of approximately 74+ RC or greater, while the module body can be formed from a mild steel. In other embodiments, the inserts can be formed from ceramics, powdered metal materials including tungsten, titanium or similar hard metal components, metal carbides, or other materials with a hardness of between approximately 74+ RC to approximately 85+ RC, or greater.

Each of the inserts 85 further each can include an insert body 86 having a tab or flange portion 87 that extends either forwardly or rearwardly, as indicated in FIG. 5, from the passage of the gauge module body, generally seating upon and engaging the upper and lower surfaces 83/82 of the module body. As additionally indicated in FIGS. 4 and 6A-6B, each of the inserts 85 also will include at least one opening or slot 89 formed along the tab or flange portion thereof, and through which a fastener, such as a set screw 90, or other, similar removable fastener, can be received. The slots or openings 89 formed in the tabs or flange portions inserts generally can be aligned with a corresponding slot or locator opening 91 formed along the upper and/or lower surfaces 83/82 of the module body to help locate and mount each insert to the body of its module and along the passage of its gauge module. As also indicated in FIG. 6B, the inserts can be shifted laterally, across the module body and substantially parallel to the passage 80, and further can be adjustable toward and away from each other across the passage of the gauge module body, after which fasteners can be inserted therein and tightened to secure the inserts 85 to their module body.

Additional locator guide pins 92 further can be received in slots on the locator openings 93 formed along flange or tab portions 87 of each of the inserts to additionally help position the inserts along and across the passage of the module body as needed.

In additional embodiments, the inserts 85 can be substantially integrated with their modules. The inserts can be bonded, molded, encapsulated, and/or otherwise affixed to the bodies of their modules, with the inserts being substantially integrated with the module bodies so as to form a substantially unitary construction of the module bodies, and with the inserts forming or defining a portion of the passages thereof. For example, in some cases, the inserts can be located or received within the passages of the module bodies and substantially permanently mounted thereto, while in other embodiments, the inserts can be molded or cast as a part of the module bodies themselves, defining the passage and slots for the loopers or hooks, and can be coated or treated with a hard metal coating such as a carbide or other substantially wear resistant coating. In such instances, the gauge parts can be provided in sets with their gauge modules, and can be replaced as a set by removal and replacement or substitution of the gauge modules and gauge parts as a unit. In other embodiments, the inserts can be substantially engaged or locked to their modules with a limited ability to detach or remove one or more of the inserts as needed for serviceability.

Figure 6B:
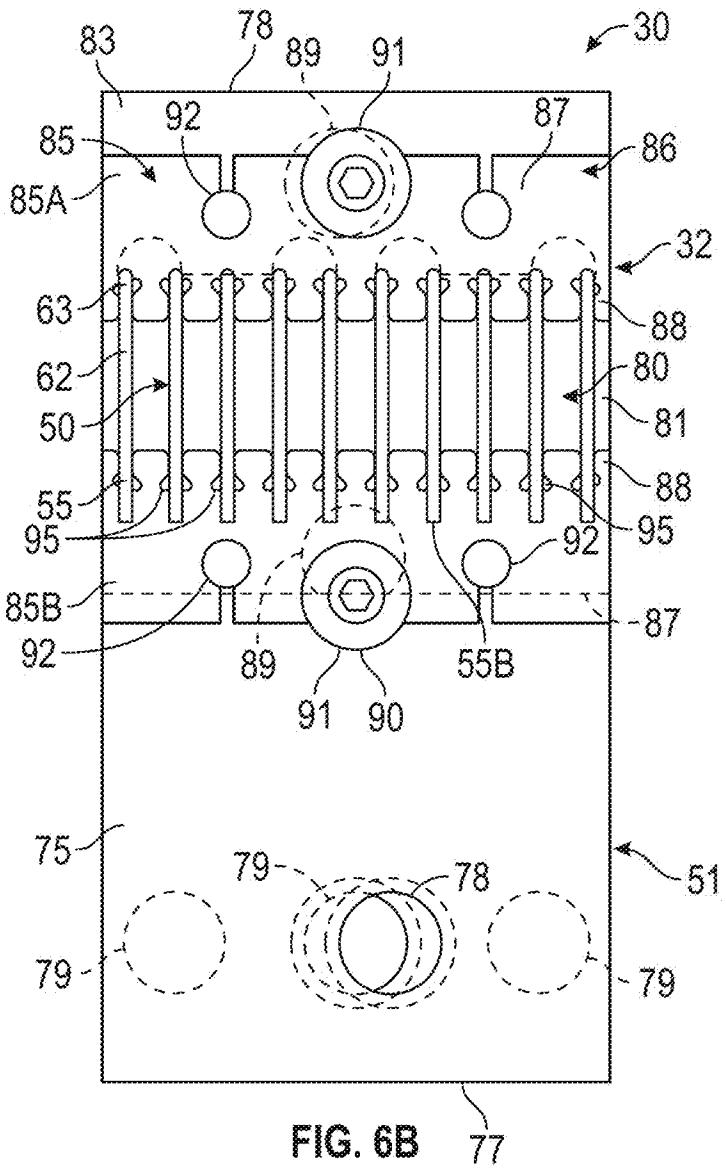
FIGS. 6A-6B are plan views of the gauge module or gauge block of FIGS. 4-5.
Figure 6A:
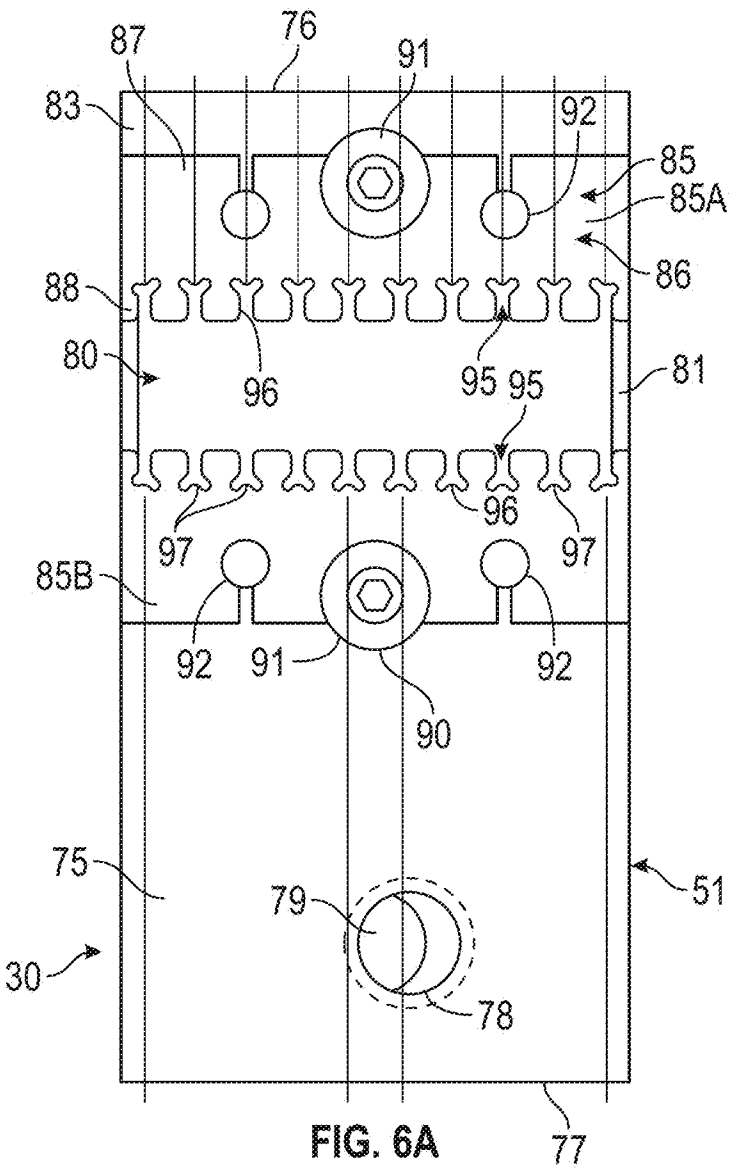

As additionally indicated in FIGS. 4 and 6A-6B, the inserts further generally will include a series of slots or slits 95 arranged in spaced series along the body 86 of each insert along a rear portion 88 thereof. Each of the slots 95 generally will be sized or configured to receive a gauge part 32, such as a hook or looper 50, as indicated in FIGS. 4 and 5, therein. The slots 95 of the inserts also generally will be arranged at a selected spacing, such as a gauge spacing for the gauge parts, and with each slot 95 of the first inserts 85A being generally aligned with a corresponding or associated one of the slots 95 of the second inserts 85B as indicated in FIG. 6A. The aligned, corresponding or associated slots of each insert will receive at least a portion of the body of each of the gauge parts received therein, e.g., portions of the front 55A and rear 55B edges of the body 55 of each looper or hook 50, and with the inserts defining contact areas 98 of a reduced or minimized area or profile between the gauge module and the loopers or hooks.

In addition, as indicated in, for example, FIG. 6A, the ends 96 of the slots 95 further can be formed with a substantially flattened or slightly bowed or arcuate configuration, so as to define a seat 97 against which the first and second edges of each of the loopers or hooks received in each slot can be located, and can bear against, for mounting of the loopers or hooks within the inserts and thereafter securing the inserts, with the loopers or hooks received therein to each gauge module. The slots of the inserts will guide the loopers or hooks as the loopers or hooks are extended or retracted or otherwise moved through the passage of their gauge module, and will help maintain the alignment of the loopers or hooks, and thus the throats and bills thereof with respect to the needles such as needles are reciprocated into and out of the backing material and are engaged by the loopers or hooks.

In another embodiment, the inserts 85 each can include an insert body 86 having a first, top or upper portion and a second, lower or bottom portion, and with an intermediate section extending therebetween and connecting the first and second portions of the body of each insert. At least one of the upper and/or lower portions of the body of each insert further can be formed as a tab or flange that extends either forwardly or rearwardly, from the intermediate section and the passage of the gauge module body, generally overlying and engaging the upper and lower surfaces 83/82 of the module body to help locate and fix each insert within the passage of its gauge module. The first and second inserts 85A/85B thus can have a substantially unitary construction, including upper and lower portions with their slots extending through their upper and lower sections and along the intermediate body sections, enabling further engagement and guiding of at least a portion of the first and second edges of the loopers or hooks. In embodiments, the inserts of such a construction can be molded or cast so as to have a substantially unitary body, which can enable a reduction of parts, reducing the need for separate inserts on the upper and lower surfaces of the module body and along opposite sides of the passage thereof, while increasing the points/area of contact between the inserts and the loopers or hooks for enhanced consistency and/or control of the movement.

Alternatively, first, second and intermediate body sections of each insert can be formed as separate components and mounted together along the passage of the module body. For example, in still further embodiments, an intermediate guide or bearing plate also can be used to help guide movement of the loopers or hooks, with the guide or bearing plate extending along the passage between inserts located along the upper and lower surfaces of the module body. Such a guide or bearing plate can provide a body or surface along which the first and second or front and rear edges of the loopers or hooks can ride/slide as they are moved along the passage of the module body. The guide or bearing plate also can act as a connecting member or section between the inserts or each pair or set of inserts 85A and/or 85B. Such a guide or bearing plate can be formed from a similar high hardness material (e.g., a hardened metal or carbide or powdered metal or other high hardness material) to provide a hardened surface against which one or both of the edges of the loopers or hooks can slide; or, in some cases, can act as a sacrificial plate that can be easily replaceable and protects the module body along the sides of the passage.

During operation of a tufting machine such as disclosed in embodiments of the present disclosure, the loopers, hooks, or other gauge parts are moved in multiple directions, including being reciprocated into and out of engagement with the needles, while also being moved in a second direction through their gauge modules or gauge blocks, e.g. being moved vertically between raised positions to engage the needles and lowered, positions, including being moved to no-sew positions, as well as, in some operations, being moved after a loop of yarn has been picked from a needle, such as to form extended or longer length loops. This tufting machine thus enables the formation of highly detailed tufted patterns that can include varying pile heights and other sculptured and multi-color pattern effects. However, such repeated cyclical movements of the gauge parts causes significantly rapid wearing of the gauge parts and particularly their gauge modules as the loopers, hooks or other gauge parts slide and their edges frictionally engage the bodies of their modules. As these parts wear, their ability to engage their needles and form loops of yarns to create tufted patterns with a substantially high degree of precision can be diminished. For example, the gauge parts can become misaligned, and/or may not engage the needles properly or with the desired level of precision, requiring more frequent replacement of the gauge parts/gauge modules.

The use of metals (such as high hardness heat treated steels), metal carbides, ceramics, and/or other hardened metal materials, including powdered metals including tungsten, titanium or other, similar high hardness materials, which provides the inserts with a hardness of at least 75+ RC or greater, and the configuration of the inserts defining contact areas 98 between the loopers or hooks and the gauge modules with a minimized area or profile, substantially increases the wear life to the gauge modules and the loopers or hooks. The high hardness of the inserts protects the gauge modules from direct contact with and rapid wearing as the loopers or hooks are cycled therethrough, while the reduced size of the contact areas 98 defined by the inserts are configured to reduce frictional engagement of the inserts with the loopers or hooks, while substantially consistently guiding and maintaining the alignment of the loopers or hooks during such movement. The loopers or hooks also generally will be pre-hardened or heat treated so as to harden the looper or hook bodies; and in some embodiments, the surfaces of the looper or hook bodies can be coated, treated or bonded with a reduced friction material to help reduce friction between their edges 55A/55B that engage and slide along the slots of the inserts, and thus help increase wear life thereof. For example, in some applications, the wear life of the loopers or hooks has been found to exceed upwards of 50 million to 100 million machine cycles, and in some embodiments, between at least about 100 million to 500 million cycles or greater.

The increased hardness of the inserts protects the gauge modules and enables the gauge modules to be formed from substantially lighter weight and lower hardness materials such as mild steels, aluminum, or alloys thereof. For example, instead of requiring the gauge modules to be formed from substantially high hardness materials such as tungsten, and/or be substantially heat treated to try to significantly increase the hardness thereof, the gauge modules can be cast, molded or otherwise formed from lightweight metals, composites or other, similar materials with hardness's that can be substantially lower than that of the inserts (e.g. the bodies of the gauge modules can be formed from mild steels or aluminum alloys with a hardness less than about 60 RC) which helps reduce weight and cost of the overall gauge part assembly without reducing operational cycle performance. Such a reduction in weight of the gauge modules or blocks further can provide enhanced control of the movement of the loopers through the passage of their gauge modules, as well as the reciprocation of the loopers or hooks toward and away from the needles, e.g., by reducing inertia that may need to be overcome during the reciprocation of the loopers or hooks toward and away from the needles.

FIGS. 7A-7E illustrate an embodiment of a gauge module or gauge block 151, that includes a body 152 adapted to mount along a gauge bar. As illustrated in FIGS. 7A-7C and 7E, in some embodiments, the body 152 of the gauge module 151 can have a reduced size, and, in embodiments, can have a substantially h-shaped or y-shaped configuration, although other configurations also can be used, including other generally non-square or non-rectangular configurations. The body 152 of each gauge module 151 further will be configured to receive a series or set of gauge parts 32, such as loopers or hooks 50 therein.

In some embodiments, the body 152 of each gauge module 51 will be formed from a metal or metal alloy material, although various composites, synthetic materials and/or other materials also can be used. For example, and without limitation, the body of the gauge module can be made from a lightweight steel, such as a mild steel or tool steel, or aluminum, or other, similar lightweight yet substantially rigid and durable materials. In embodiments, the module bodies can be cast, molded or otherwise formed.

In addition, in embodiments, the gauge modules can have a reduced profile or configuration adapted to help reduce weight of the gauge modules. In some embodiments, the gauge modules can comprise a skeletonized construction, which, in some constructions, can include portions of the body that have been removed, that have reduced size (e.g., thickness, length, width, or combinations thereof), or a reduced weight, or combinations thereof. Still further, in embodiments, the material from which the body of the gauge module is formed can be selected to provide a reduction of weight of the gauge modules, while still providing sufficient durability and rigidity to hold and/or substantially maintain the gauge parts in their alignment or position for picking yarns from corresponding ones of the needles during reciprocation of the gauge parts toward and away from the needles during operation of the tufting machine. For example, in embodiments, stronger metal or metal alloy materials can be used to form at least some portions of the body, which can be formed with a reduced profile and/or with portions removed to help offset weight.

Figure 7B:
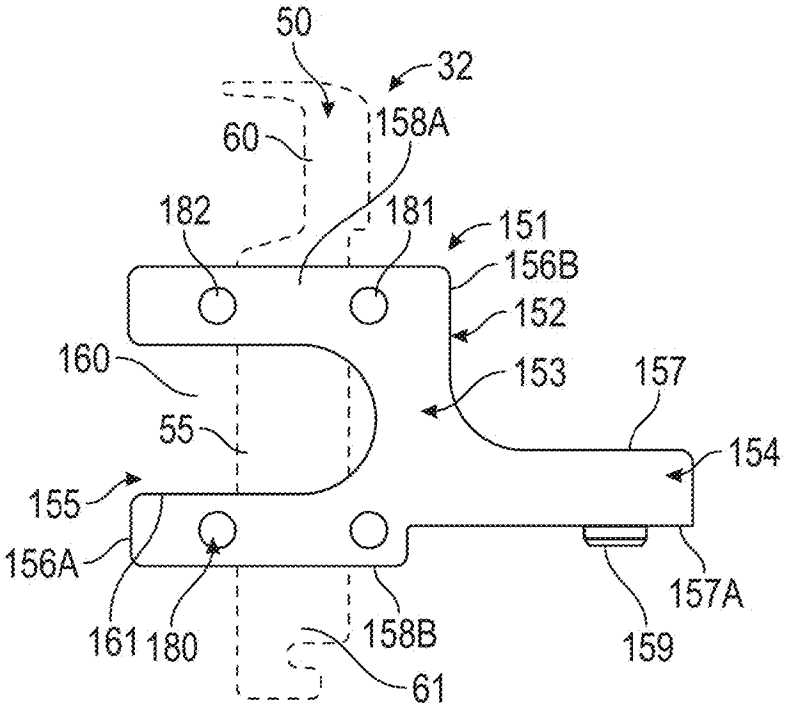
FIGS. 7A-7E illustrate another embodiment of a gauge module or gauge block according to principles of the present disclosure.

In the example gauge module construction generally illustrated in FIGS. 7A-7C and 7E, the body 152 of the gauge module 151 is shown as having a generally h-shaped or y-shaped configuration. In embodiments, the body 152 of each gauge module 151 can include a first, forward or front section 153, and a second, back or rear section 154. In embodiments, such as indicated in FIG. 7B, the rear section 154 can have a thickness or height that is less than the thickness or height of the front section 153 which can provide the gauge module with a reduced profile. The front section 153 also can have a front face 156A a rear face 156B, and sides 156C (FIGS. 7A and 7C-7D); with the rear section 154 extending rearwardly from the rear face 156B, and, in some embodiments, tapering to a mounting portion 157. In embodiments, the front face 156A of the front section 153 of the body 152 can include a first or upper portion 158A and a second or lower portion 158B (FIGS. 7A-7B), with an open-ended recess or channel 155 defined therebetween.

Figure 7A:
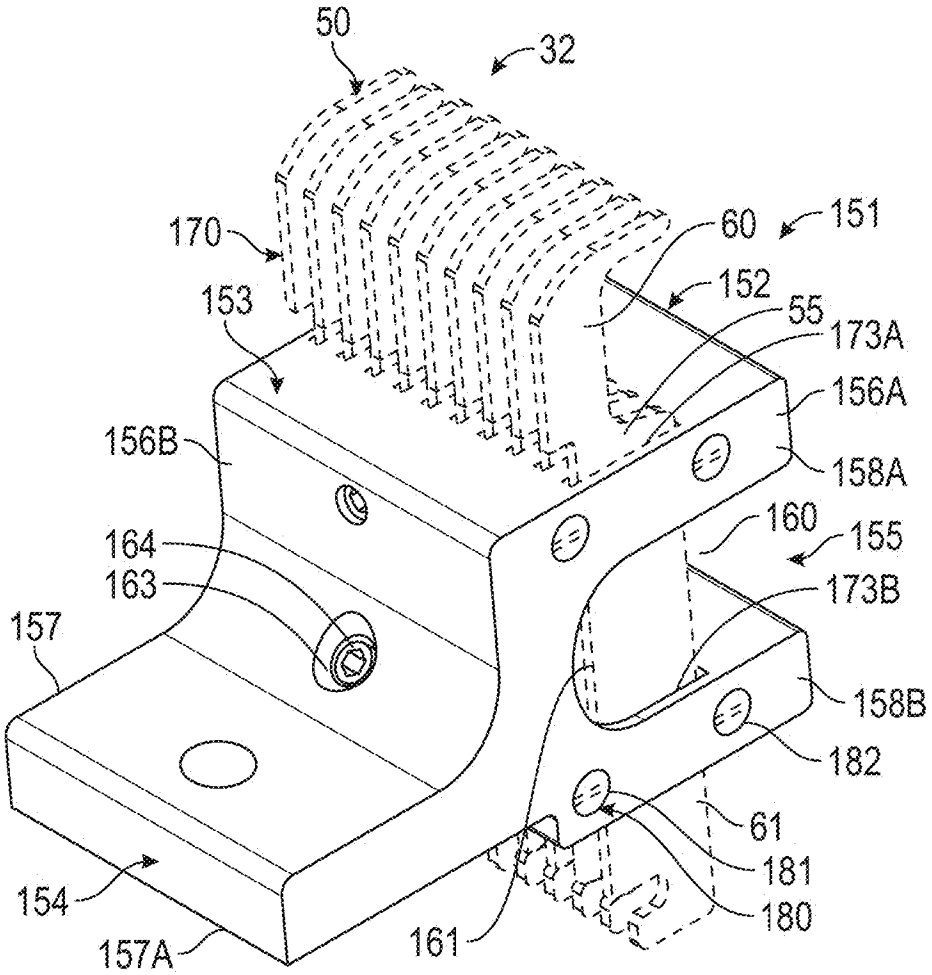
Figure 7D:
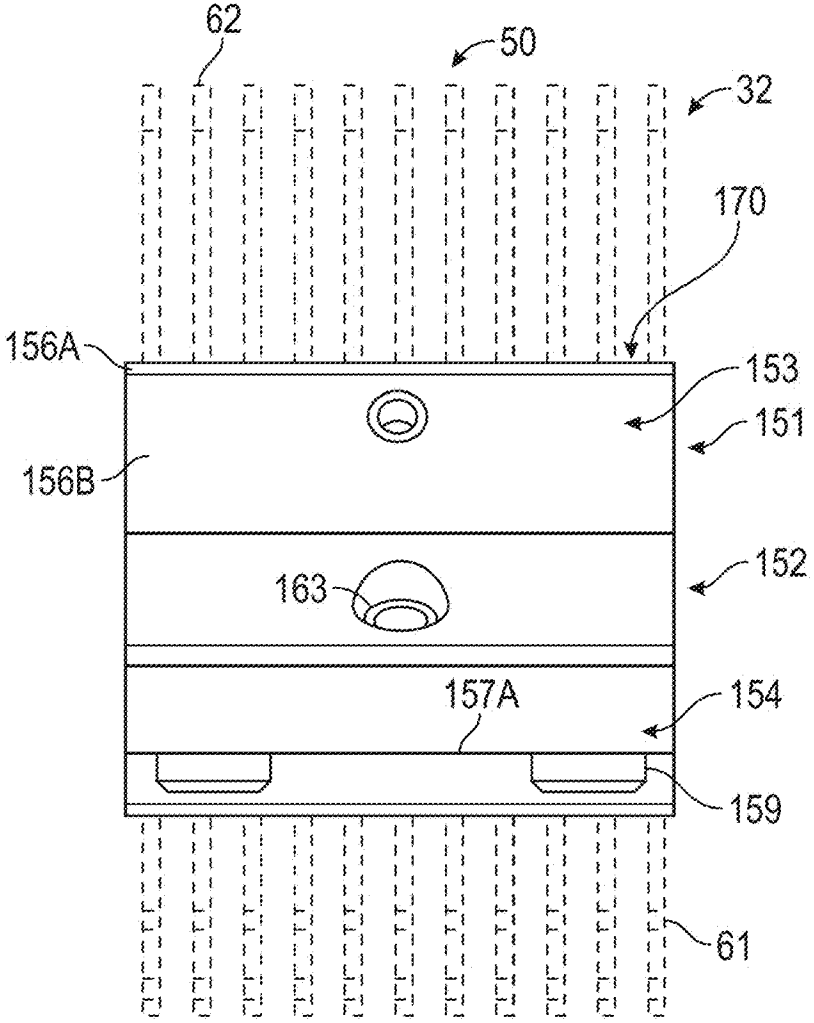
Figure 7C:
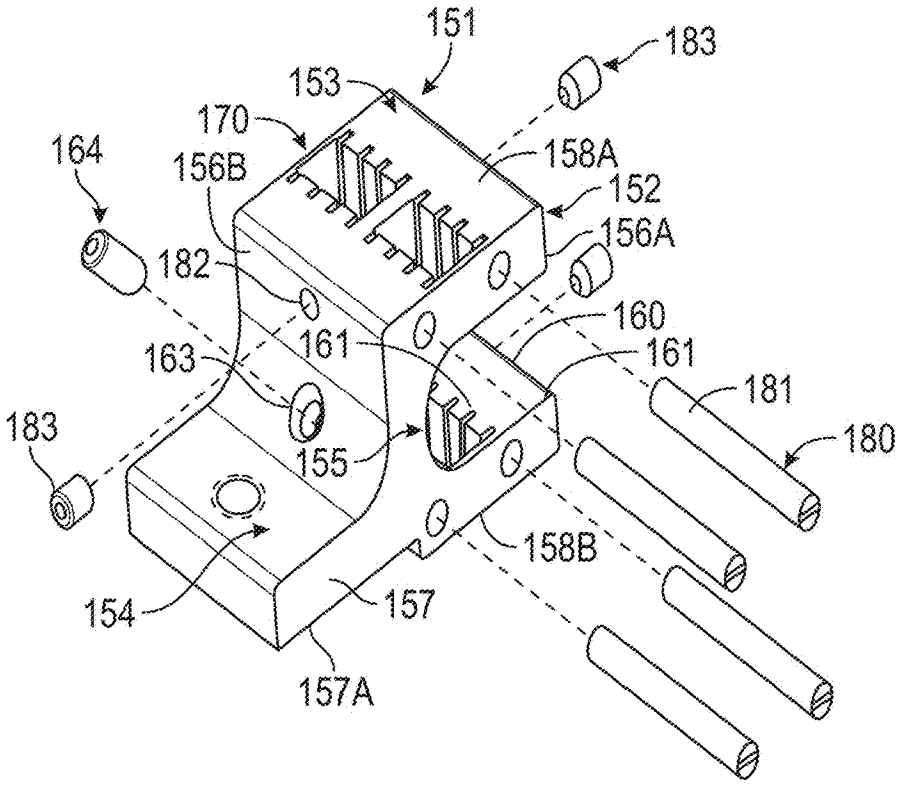

In embodiments, the mounting portion 157 of each gauge module can have a substantially reduced thickness and can be configured to engage and mount to a gauge bar, e.g., as illustrated in FIG. 7A-7C. For example, in embodiments, the rear section 154 of the body can taper downwardly from the rear face 156B of the front section 153 to the mounting portion 157. In embodiments, the mounting portion can have a lower surface 157A configured to seat on the gauge bar, and which can be spaced above a lower surface 153A of the front section 153 so as to facilitate the engagement alignment and seating of the body 152 along the gauge bar. In embodiments, the mounting portion 157 also can include tabs or other locating devices 159 (FIG. 7B) that can be positioned along the lower surface 157A thereof and which can be configured for aligning the gauge module 151 along the gauge bar.

Figure 7E:
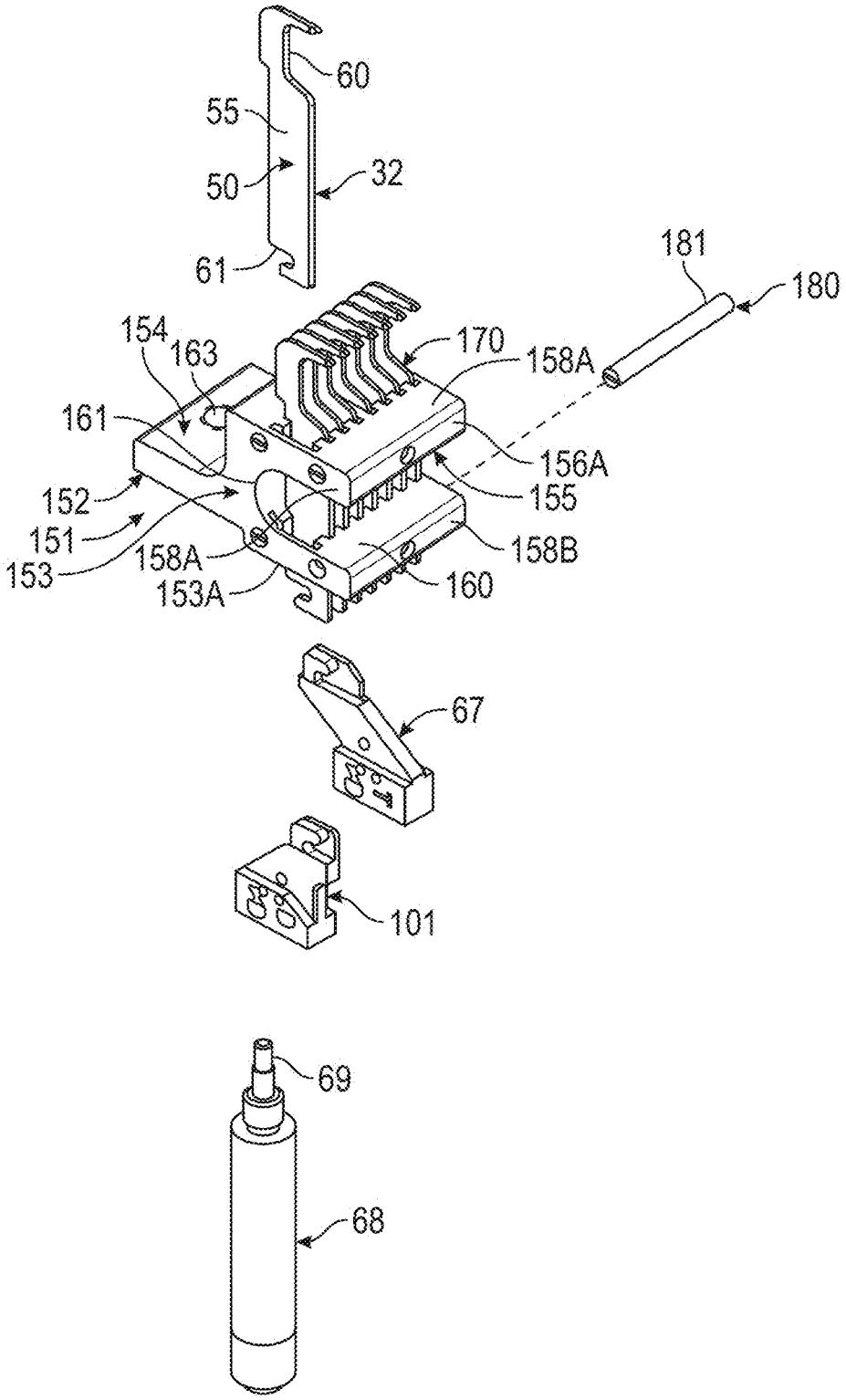

In some embodiments, the recess 155, as shown in FIGS. 7A-7B and 7E, can be configured to define an opening 160 that can help facilitate access to the gauge parts, e.g., loopers or hooks, received within and moveable through the gauge modules. For example, in some constructions, the recess can have a generally C-shaped configuration, with its opening 160 defined along the front face of the gauge module, and further can be open along the sides 161 thereof, which can enable access to the gauge parts for maintenance, such as for cleaning of dust, debris or other materials collected thereabout. In some applications, such a construction also can provide an easy visual inspection of the gauge parts within the gauge modules. In other embodiments, other configurations also can be provided.

The gauge modules further can include at least one fastener opening, such as shown at 163 in FIGS. 7A-7C, which can be located along the rear section 154 of the body, e.g., along the mounting portion 157. A removable fastener, such as a set screw, socket, hex screw, or other, similar removable fastener or attachment device, can be inserted through the fastener opening and into a corresponding opening along in the gauge bar for releasably mounting the gauge modules 151 to the gauge bar. Removal of the fastener can enable the gauge modules, with their gauge parts contained therein, to be removed and replaced as a unit, without necessarily having to replace individual gauge parts. In other embodiments, the gauge modules can be removable/replaceable for changing a gauge spacing or arrangement of the gauge parts of the tufting machine. In other embodiments, the gauge modules can be configured to enable one or more gauge parts to be selectively removed therefrom.

As further indicated in FIGS. 7A and 7C, a passage 170 can be formed through the body 152 of each gauge module 151. In embodiments, the passage 170 can be located along the forward portion 153 of the body 152. The passage 170 generally will be sized and/or configured to receive a plurality of gauge parts, such as loopers or hooks 50, therein, such as indicated in FIGS. 7B, 7D and 7E. In embodiments, the body 55 of each of the loopers or hooks 50 can be received within and extend through the passage 170, with the first portions 60 of each of the loopers or hooks generally projecting downwardly past a lower or bottom surface 171 of the body 152 of their gauge module 151, while the second portion 61 of each looper or hook can extend/project upwardly from and above an upper or top surface 172 of the body 152. The passage 170 further can be configured to enable the movement of the loopers or hooks therealong.

As shown in FIGS. 7C and 7E, in embodiments, the passage 170 will extend through the recess 159. For example, in some embodiments, a first portion of the passage 173A can be defined through the upper portion 158A of the body 152, and a second portion 173B of the passage can be defined in the lower portion 158B of the body 152; with the second portion of the passage being spaced from and aligned with first portion of the passage. In addition, in embodiments, the passage can extend at an angle, and, in some embodiments, the passage and/or the front and rear faces of the front section can be arranged at an angle so as to enable the gauge parts to be oriented at an angle, if needed, as discussed above.

In addition, in some constructions, as indicated in FIG. 7C, the first and second portions of the passage 173A and 173B can be divided, e.g., separated into sections 174. By way of example only, in embodiments, the passage can be divided to multiple sections for accommodate a selected gauge spacing, e.g., $1/10^{th}$ inch, $1/8^{th}$ inch, $5/16^{th}$ inch, or other spacings. In embodiments, the passage can include a wall or divider 176 arranged along an intermediate portion of the passage between the sides 156C of the front section 153 of the body 152. In embodiments, the divider 176 can be formed with or otherwise be integral with the body of the gauge module; while in some embodiments, the divider, or multiple dividers, can be configured to be insertable into and/or removeable from the passage 170 for dividing the passage into two or more sections 174 as needed.

In embodiments, a plurality of slots or grooves 177 can be formed along one or both of the upstream and downstream or front and rear edges 174A and 174B of the passage 170, as indicated in FIGS. 7A and 7C; although in other embodiments, such slots or grooves 177 may not be used. In addition, the number of slots or grooves 177 formed in the gauge modules can be varied to match various selected applications, and further can be configured to receive one or more dividers as noted above. For example, the number of slots or grooves can match a gauge spacing for the gauge parts, or a multiple of such a gauge spacing. In some embodiments, as shown in FIG. 7E, the slots or grooves 177 may be configured, e.g., having a depth and/or width configured to receive at least a front or rear edge portion of a looper or hook 50 therein such that the looper or hook can move along the slots in a direction substantially normal to a direction of reciprocation of the loopers or hooks toward and away from the needles during a tufting operation.

In addition, the gauge modules 151 also can include one or more inserts 180. In embodiments, the inserts 180 can be positioned adjacent the passage defined through the body 152 of each gauge module, as generally indicated in FIGS. 7C and 7E. The inserts generally will be configured to provide contact areas between the gauge parts and the body of the gauge module, against which the gauge parts can engage as the gauge parts are moved through and along the passage 170. For example, in some embodiments, a series of inserts 180 can be received within the body of the gauge module 151, being positioned along front and rear or upstream and downstream sides 170A/170B of the passage 170 and acting as wear surfaces that can protect the body of the gauge module from undue wear as the gauge parts slide through the passage.

In embodiments, the inserts can be received within the body of the gauge module (e.g., being received within passages formed in the body) and can be removable therefrom; while in some embodiments, the inserts can be substantially integrated with the body of the gauge module. In embodiments, such as illustrated in FIGS. 7C and 7E, the inserts 180 can be arranged in sets, with one or more insets arranged in a substantially, opposed, parallel relationship with the gauge parts 32 received within the passage 170.

In embodiments, the inserts 180 can comprise pins, bars or rods that can be received in passages or openings 183 in the body of the gauge module. Each of the inserts 180 further generally will be formed from a material having a hardness that is different from, e.g., greater than, the material of the body of the gauge module. As discussed above, in embodiments, the inserts 180 can comprise a hardened metal or metal alloy material, a metal carbide, ceramics, and/or powdered metal materials including metal powders including tungsten, titanium, or other materials having a hardness that is greater than the hardness of the material of the gauge module body. For example, in some embodiments, the inserts can be formed from a metal carbide material having a hardness of approximately 74+ RC or greater, while the module body can be formed from a mild steel. In other embodiments, the inserts can be formed from ceramics, powdered metal materials including tungsten, titanium or similar hard metal components, metal carbides, or other materials with a hardness of between approximately 74+ RC to approximately 85+ RC, or greater.

As illustrated in FIG. 7E, in embodiments, the gauge parts 32 (e.g., loopers or hooks 50) can be received within the passage 170, extending through the open-ended recess 155 and both the upper and lower portions of the front section 153 of the body 152. The lower ends of the gauge parts can project below the lower surface 153A of the front section and, in embodiments, can be engaged by gates or connectors 67 coupled to actuators 68 for controlling movement of the gauge parts through the gauge module. In embodiments, at least a portion of the bodies of the gauge parts will be exposed, and thus accessible through the opening 160 defined by the recess 155, which can help facilitate cleaning, e.g., removal of dust and debris, and other maintenance, as well as allowing for visual inspection of the gauge parts.

FIGS. 8A-10B illustrate various non-limiting embodiments of gates or connectors 67 that can be used with the gauge parts, such as the loopers or hooks 50 (FIG. 4) for linking the gauge parts to their associated actuators 68 (FIGS. 2-3). It will, however, be understood by those skilled in the art, that the connectors or gates illustrated in the embodiments of FIGS. 8A-10B are not limited to use with a particular tufting type of machine or with particular types of gauge parts, and can be used with a variety of different types of gauge parts, including the loopers or hooks 50 such as illustrated in FIGS. 4-6B, and FIGS. 11A-12C, as well as for use with various other types of gauge parts, such as arrangements of level cut loop loopers or hooks and/or other gauge parts.

As generally illustrated in FIGS. 8A-10B, the connectors or gates 67 generally will each include a housing or support structure 101 within which a linkage or connector arm 102 can be substantially contained, encased or housed. The housing 101 of each connectors or gate generally can include a first, or proximal portion 103, an intermediate portion 104, and a second or distal portion 106. In addition, each connector body further will include a passage or channel 107 defined therethrough, and along which the linkage or connector arm 102 will be received and can move. The housing 101 of each connector 67 generally can be formed from a lightweight, durable material, such as a composite, plastic, or synthetic material, or combinations thereof. For example, a composite or polymer material such as a nylon, polyamide, paramide nylon, or other, similar polymer material, can be used, and can be mixed or provided with or otherwise include a fibrous fill material, such as carbon fiber, a glass fiber, or other supporting fibers that can additionally provide reinforcement to the housing body material. The material of the bodies of the housings further can be adapted or selected to provide not only a reduced weight, such as to help reduce inertia during starting/stopping and movement, e.g., extension and/or retraction of the gauge parts by their associated actuators, but also to provide elasticity and shock reduction or dampening or cushioning effect during such movements and starting/stopping operations.

As indicated in FIGS. 8A-10B, in some embodiments, the housing 101 of each of the connectors can be over-molded over its linkage or connector arm 102 or can be formed in sections and applied about the linkage or connector arm such that its linkage or connector arm is substantially enclosed or contained therein. The linkage or connector on 102 further can be made from a metal such as steel or other, similar high strength material, selected to provide high strength and rigidity sufficient to enable each linkage or connector arm to withstand repeated shocks and increased movement cycles during operation of the tufting machine. For example, and without limitation, the linkages or connector arms 102 can comprise a hardened steel material, and in some cases, can further be heat treated or annealed, such as at the ends thereof, at areas of contact and/or engagement with the loopers or hooks, and between the connector arm or linkage and the drive shaft or rod of its associated actuator or actuators.

In some embodiments, the linkage or connector arm 102 further can include a skeletonized metal body configured to enable a reduction of the weight thereof. In such embodiments, each connector or housing 101 can provide further support and rigidity to the linkage or connector arm 102, helping to guide and maintain a consistent reciprocating movement or motion thereof during operations. As a result, the connectors or gates 67 can provide a more economical connector or gate design, enabling linkages or connector arms having a skeletonized or reduced profile and lighter weight to be used with additional support and impact elasticity and dampening effects provided by the housings 101 applied over and/or encasing or encapsulating the linkages or connector arms.

As further illustrated in FIGS. 8A-10B, each of the connectors or gates 67 can be formed with varying sizes and configurations. For example, the intermediate sections of each connector housing can have shorter or longer spans depending on a gauge, distance, length of travel or the length of the linkage or connector arm, and thus can be varied for different tufting machines and/or tufting applications. By way of example only, as indicated in FIGS. 8B, 9B and 10B, the connectors or gates can comprise varying configurations for use with different gauge tufting machines, such as ⅛th gauge or 1/10th gauge machines, though it will be understood that other gauges (5/16th, 1/16th, 1/12th, 1/14, etc.) and/or type machines also can be used. The intermediate section of the housing through each connector further can be oriented at an angle, in some cases being oriented at a downwardly extending angle, while in other cases being oriented at an upwardly extending angle, with adjacent connectors at the opposite angle orientations or configurations to minimize space or footprint taken up thereby.

The linkage or connector arm 102 (FIGS. 8A, 9A, 10A) of each connector or gate 67 further can be formed in varying lengths as needed or desired. Each linkage generally will have a first or proximal end 110, which can be adapted or configured to engage or connect to one or more actuator shafts or drive rods 69 of an associated actuator or actuators 68, with a generally angled body section or portion 111 that extends along the passage or channel of the housing, through the housing of the connector, and terminating at a distal, flanged or hooked end 112. The body portion 111 of each linkage further will be located and/or aligned within the passage of its housing and enclosed therewithin to help provide stability and/or to help guide movement of the linkage along the channel of its connector housing.

For example, in some instances, pins or other inserts can be used during formation of the housings about or over their linkages to align and support the linkages in position, which pins can be removed thereafter. Alternatively, some guide pins can be provided to help maintain and guide movement along one or more portions of the linkage or connector arm, including or acting as bearings. Still further, in some other embodiments, a slot also can be provided along the body of each housing, through which a guide pin can be received to help guide movement of the linkage and can further help provide further impact elasticity.

In additional embodiments, a guide pin or fastener 114A can be inserted through the housing and into the body of the linkage, and can engage a slot or guideway, or similar means for helping guide and control or maintain the movement of the linkage along the passage or channel 107 (FIGS. 8B, 9B and 10B) of its connector housing without twisting or turning or otherwise becoming misaligned. In still other embodiments, the guide pin 114A can act as a pivot point about which the linkage or connector arm can be moved or pivoted rather than being moved in a substantially linear movement.

Figure 8A:
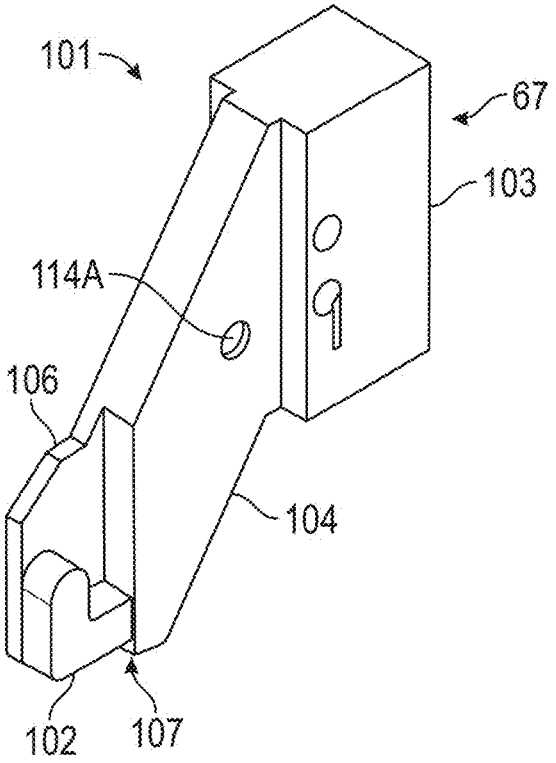
FIGS. 8A-B illustrate an embodiment of a connector for connecting the gauge parts to their actuators according to principles of the present disclosure.
Figure 8B:
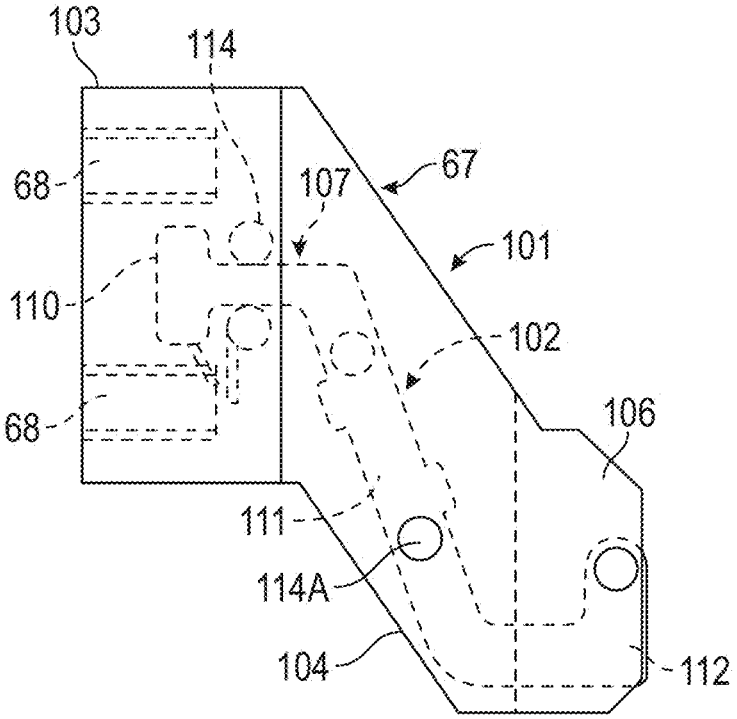
Figure 9A:
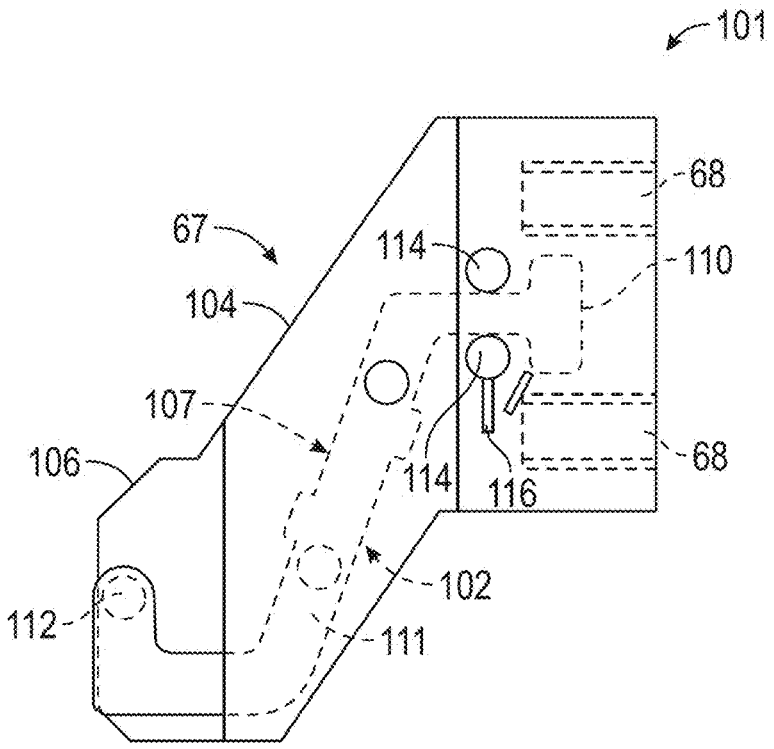
FIGS. 9A-9B illustrate another embodiment of a connector for connecting the gauge parts to their actuators according to principles of the present disclosure.
Figure 9B:
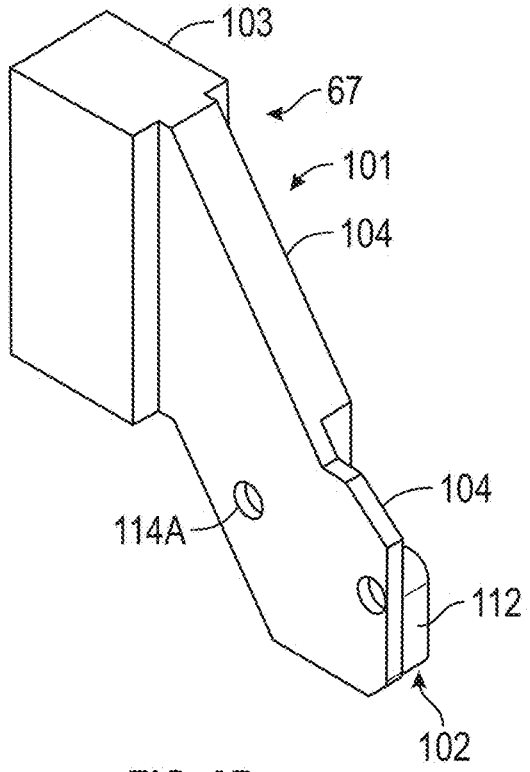

As further indicated in FIGS. 8A, 9A and 10B, the distal hooked end 112 of each of linkage or connector arm 102 can be supported along at least one side thereof by the second or distal portion 106 of its housing 101, to help guide and support the hooked end during the sliding movement of the linkage. The hooked end of the linkage or connector arm will engage the corresponding hooked portion, recess or slot of a corresponding gauge part; for example, in embodiments, engaging the slot or recess 64 (FIG. 5) formed in the first portion 60 or distal end of a corresponding or associated one of the loopers or hooks 50. In other embodiments, the hooked end of the linkage can engage a clip for a level cut looper, a level cut looped looper, or other movable gauge part. As each actuator is selectively fired or activated/deactivated, the movement of its actuator shaft or drive rod will be translated to an associated one of the gauge parts via the linkage or connector arm of its corresponding connector or gate The connectors or gates thus can provide an economical, rigid and high strength connection between each of the actuators and their associated gauge parts, with the gauge parts being removable or changeable, as needed, without having to replace the actuators associated therewith.

In one embodiment, as generally illustrated in FIGS. 2 and 12A-12C, the actuators can comprise hydraulic, air, electric, or pneumatic cylinders 68, each including a cylinder rod or shaft 69 that generally will be connected to an associated or corresponding one of the loopers or hooks by a connector or gate 67. In some embodiments, the actuators further could be used to control operation of more than one looper or hook 50. In addition, other types of actuators, including solenoids, motors or other, similar actuating mechanisms, as will be understood by those skilled in the art, also can be used.

Figure 12A:
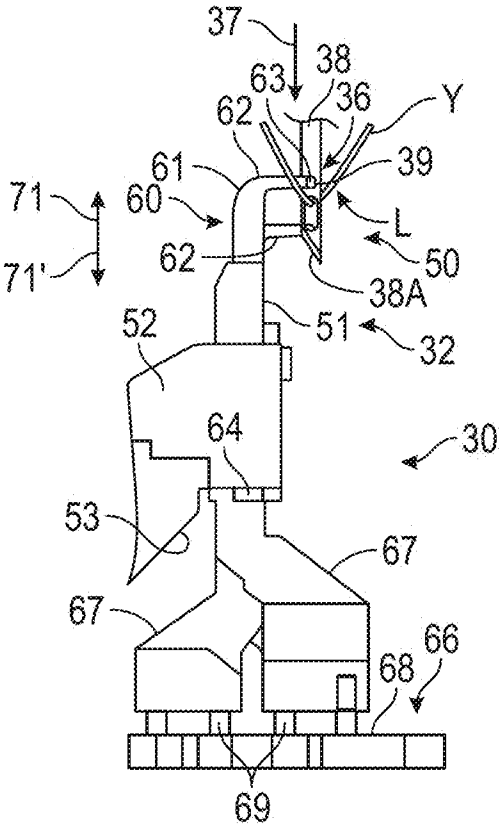
FIGS. 12A-12C are side elevational views illustrating an embodiment of an operation of the selectively actuatable gauge parts in accordance with the principles of the present disclosure.
Figure 12B:
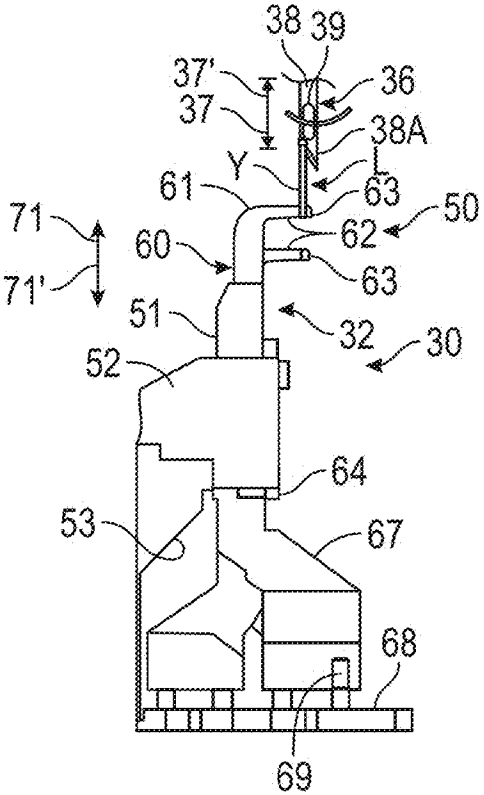
Figure 12C:
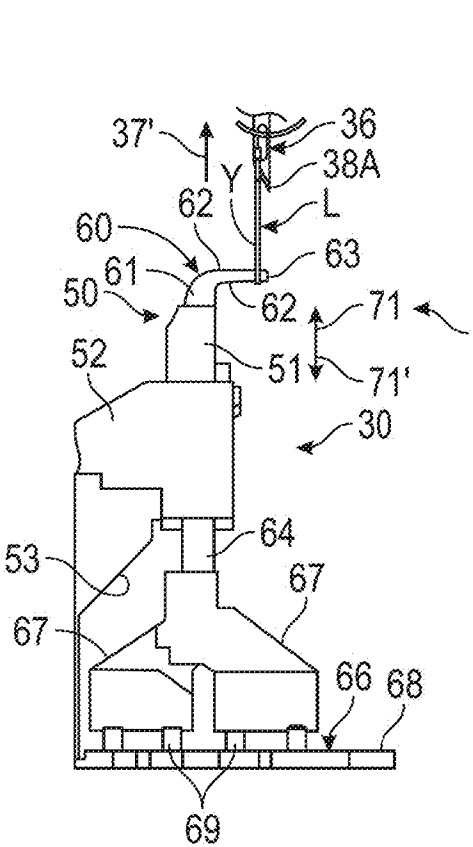

Each of the actuators generally will be linked to the control system 25, which will selectively control the actuation thereof so as to control the firing and/or movement of each of the loopers with respect to the needles. The actuators will be controlled to selectively extend and retract their loopers or hooks so that the position of their throats/bills can be varied in a second direction with respect to the reciprocation of the needles into and out of the backing material, and with respect to the movement of the loop loopers or hooks 50 in the direction of arrows 54/54'. For example, in embodiments, the loopers or hooks will be moved in a substantially vertical (i.e., a generally up and down) movement with respect to the needles, as illustrated by arrows 71 and 71' in FIGS. 2, 4 and 12A-11C, as the loopers or hooks are reciprocated in the direction of arrows 54 and 54' toward and away from the needles 36. The actuators can be controlled to not only extend and retract the loopers or hooks between extended and/or no-sew positions, but further can be selectively controlled so as to extend and/or retract the loopers to a series of varying positions or elevations with respect to the stroke or depth of penetration of the needles. Thus, the position or location of the throats of the loopers or hooks with respect to the needles can be controlled and varied so as to cause the pick-up and/or formation of loops of yarns from selected ones of the needles at varying pile heights or lengths, or no pick-up of yarns, such as indicated in FIGS. 12A-12C.

For example, in a fully extended position, selected ones of the loopers or hooks 50 can pick up loops of yarns from the needles engaged thereby, which loops generally can be formed with a first selected or desired pile height, whereas other ones of the loopers or hooks can be extended or retracted to positions or locations between fully extended and retracted positions so as to pick up and form loops of yarns with second or other, differing lengths or pile heights. Some of the loopers or hooks also can be moved to a fully lowered or retracted position by their actuators so as to place them in a no-sew position whereby the throats/bills of such loopers or hooks are located below a full penetration depth or end of stroke of the needles and thus will not pick up loops of yarns from their corresponding or respective needles. In other operations, the actuators can be selectively controlled or triggered to retract or lower their respective loopers or hooks after a loop of yarn has been captured thereon, so as to pull such captured loops of yarns lower, to elongate or create higher pile or increased length yarns for additional patterning effects, such as for tip shearing and/or other texturing effects.

Figure 11B:
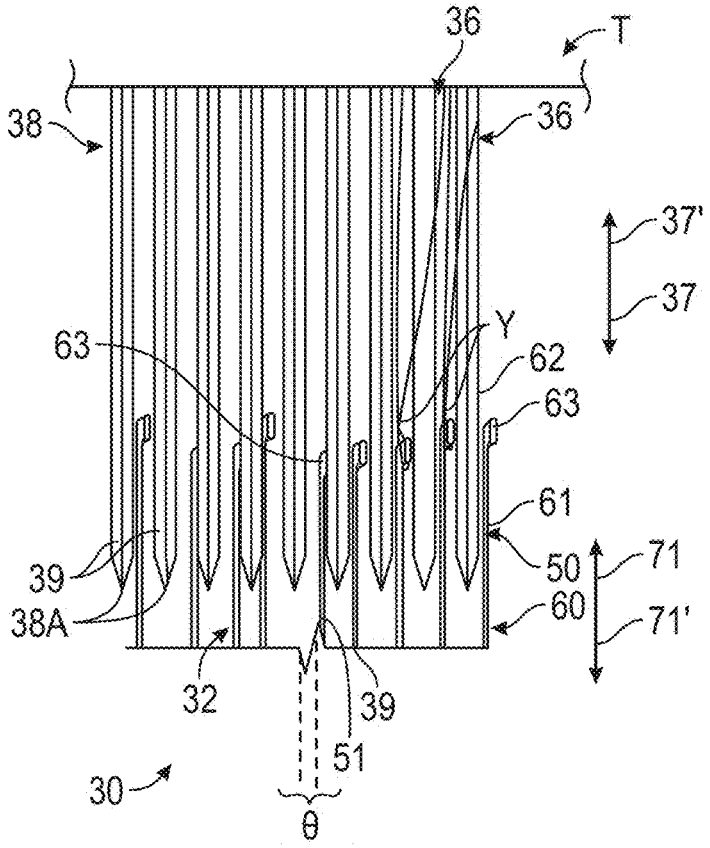

As indicated in FIGS. 11A-11B, each of the gauge parts 32, such as loopers or hooks 50 generally can be arranged in sets or groups each contained in a module 51/151 with the modules mounted in series along the gauge bar to provide a plurality of gauge parts arranged at a prescribed spacing (e.g., a gauge spacing such as 1/10th, 1/8th, 5/16th, etc.) across the tufting zone. The gauge parts 32 will be positioned so as to engage the needles, including being arranged in a substantially in-line, offset, staggered, and/or other configuration as needed depending upon the configurations of the needles of the needle bar or needle bars (for example, if the needles are arranged in an in-line, staggered and/or other arrangements along a single or dual needle bars). Each of the loopers or hooks 50 further can be arranged at an angle or offset with respect to the needles penetrating the backing so as to move or be extensible/retractable along an angled path of travel 71/71' with respect to the needles and/or the take-off point thereof. Such an offset movement of the loopers or hooks additionally can be varied as needed to minimize potential engagement of the loopers or hooks by the needles as the loopers are being retracted, depending upon spacing and/or arrangement of needles.

For example, in some embodiments, the loopers or hooks can be arranged and/or moved along a path of travel at an angle/offset, indicated at θ in FIG. 11B, that can range from approximately 1° to approximately 10° or more from the vertical and/or with respect to the stroke of the needles when the loopers or hooks are retracted, and one example embodiment at an angle of approximately 4° to 6° with respect to the path or direction of reciprocation of the needles, as the needles complete their stroke or reciprocation into and out of the backing; while in other embodiments, substantially no offset, i.e., an approximately 0° angle with respect to the needles, can be provided between the loopers or hooks and needles. Thus, as the loopers or hooks are extended to positions/elevations sufficient to engage the take-off areas 39 (FIGS. 11A-12A) of the needles, the throats/bills thereof generally will be properly aligned or positioned to engage and pick-up loops of yarns from their corresponding needles. As the loopers or hooks are retracted, they generally can further be moved along an offset path of travel so that their throats/bills can be placed or located at positions out of the path of travel of the needles to minimize potential inadvertent yarn pick-up when the loopers or hooks are being moved to and/or are in retracted, no-sew positions.

In operation, according to some embodiments, tufted articles can be formed according to the system and method of the present disclosure, which tufted articles can be formed with various patterns and pattern effects, including the use of multiple different color and/or type yarns for forming such patterns, as well as including sculptured or multiple pile height effects. For example, the system and method of the present disclosure can be operated in conjunction with a stitch distribution control system or yarn color placement system such as disclosed and illustrated in U.S. Pat. Nos. 8,141,505, 8,359,989 and 8,776,703, the disclosures of which are incorporated by reference as if set forth fully herein.

In such embodiments, the stitches or tufts of yarns being formed in the backing material further can be formed at an increased or higher actual operative or effective process stitch rate as compared to the fabric or pattern stitch rate that is desired or prescribed for the tufted pattern being formed. If the pattern or fabric stitch rate or density of a pattern being formed calls for the tufted article to have an appearance of 8, 10, 12, etc., stitches per inch formed therein, and/or which are to be shown on its face, the actual, operative or effective number of stitches per inch formed during operation of the tufting machine will be substantially greater than the desired or prescribed pattern or fabric stitch rate. Thus, the actual formation of stitches or tufts of yarns in the backing material will be accomplished at an increased actual, operative or effective process stitch rate, whereby effectively, a greater number of stitches per inch than will be required to be shown in the finished pattern will be formed in the backing material, with those stitches or face yaws that are not desired to be shown or remaining in the face of the pattern field or area being sewn being back-robbed or pulled out of the backing material, or pulled sufficiently low to an extent to enable such yaws to be held or tacked in the backing while substantially avoiding creation of undesired or unnecessary gaps or spaces between the retained or face yarns of the pattern (i.e., the tufts of yarns that are to remain visible or appear in the finished pattern of the tufted article).

For purposes of illustration, in one example embodiment, the effective process stitch rate can be based upon or determined by increasing the fabric or pattern stitch rate of the pattern being formed approximately by a number of colors selected or being tufted in the pattern. For a pattern having a desired fabric or pattern stitch rate of about 10-12 stitches per inch, and which uses between 2-4 colors, the effective or operative process stitch rate (i.e., the rate at which stitches are actually formed in the backing material) can be approximately 18-20 stitches per inch up to approximately 40 or more stitches per inch. However, it further will be understood by those skilled in the art that additional variations of or adjustments to such an operative or effective process stitch rate run for a particular pattern can be made, depending upon yarn types and/or sizes and/or other factors. For example, if thicker, larger size or heavier yarns are used, the effective process stitch rate may be subject to additional variations as needed to account for the use of such larger yarns (e.g., for 4 color patterns, the effective process stitch rate can further vary, such as being run at about 25-38 stitches per inch, though further variations can be used as needed). Thus, where a selected or programmed pattern being run may be designed or desired to have ten to twelve stitches per inch as a desired pattern density or stitch rate therefor, the system may actually operate to form upwards of twenty to forty-eight or more stitches per inch, depending on the number of colors and/or types of yarns, even though visually, from the face of the finished tufted article, only the desired/selected ten to twelve stitches generally will appear.

Additionally, where a series of different colors are being tufted, the needles 36 of the needle bar 35 generally will be provided with a desired thread up, for example, for a four-color pattern an A, B, C, D thread up can be used for the needles. Alternatively, where 2 needle bars are used, the needles of each needle bar can be provided with alternating thread up sequences, i.e., an A/C thread up on the front needle bar, with the rear needle bar threaded with a B/D color thread up. In addition, the needles of such front and rear needle bars can be arranged in a staggered or offset alignment. The needle bar or needle bars further generally will be shifted by control of the needle bar shifter 40 (FIG. 2) in accordance with a shift profile for the pattern being formed, in conjunction with the control of the backing material and control of the yarn feed so as to effectively present each one of the colors (i.e., 2, 3, 4, 5, etc.) of yarns or each different type of yarn that could be sewn at a selected pattern pixel or tuft/stitch location to the looper or hook by shifting of the needle bar transversely with respect to the backing material as the backing material is fed through the tufting zone.

For example, for a four color pattern, each of the one-four colors that can be sewn at a next pixel or stitch location, i.e., one, two, three, four, or no yarns can be presented at a selected pixel or stitch location, will be presented to a desired looper or hook as the backing material is moved incrementally approximately ⅛th-¼0th of an inch per each shift motion or cam movement cycle. The loopers or hooks will engage and form loops of yarns, with a desired yarn or yarns being retained for forming a selected tuft, while the remaining yarns generally can be pulled low or back-robbed by control of the yarn feed mechanism(s), including pulling these non-retained yarns pulled out of the backing material so as to float along the backing material. Accordingly, each looper or hook is given the ability to tuft any one, or potentially more than one (i.e., 2, 3, 4, 5, 6, etc.,) of the colors of the pattern, or possibly none of the colors presented to it, for each pattern pixel or tuft/stitch location associated therewith during each shift sequence and corresponding incremental movement of the backing material. As noted, if none of the different type or color yarns is to be tufted or placed at a particular tuft or stitch location or pixel, the yarn feed can be controlled to limit or otherwise control the yarns of the needles that could be presented at such stitch location or pixel to substantially pull back all of the yarns or otherwise prevent such yarns from being placed or appearing at that stitch location, and/or the needle bar additionally could be controlled so as to jump or otherwise bypass or skip presentation of the needles/yarns to that stitch location or pixel.

The feeding of the backing material B further can be controlled, i.e., by the stitch distribution control system in a variety of ways. For example, the tufting machine backing rolls 28 can be controlled to hold the backing material in place for a determined number of stitches or cycles of the needle bar or can move the backing material at a desired number of stitches per inch, i.e., move about 1/40th of an inch for each penetration, or variations thereof so as to move about 1/10th of an inch as four stitches are introduced in the backing for a pattern with four colors and an effective stitch rate of 40 stitches per inch. The movement of the backing material further can be varied or manipulated on a stitch-by-stitch or pixel basis with the average movement of all the stitches over a cycle substantially matching the calculated incremental movement of the operative or effective process stitch rate. For example, for a 4-color cycle, a first stitch can be run at 1/80th of an inch, the next two at 1/40th of an inch, and the fourth at 1/20th of an inch, with the average movement of the backing over the entire 4-stitch cycle averaging 1/40th of an inch for each stitch presented, as needed, to achieve a desired stitch/color placement.

Each different yarn/color yarn that can be tufted at a particular stitch location or pixel thus can be presented to such stitch locations or pixels as the pattern is formed in the backing material. To accomplish such presentation of yarns at each pixel or stitch location, the needle bar(s) generally can be shifted as needed/desired per the calculated or selected cam profile or shift profile of the pattern to be run/formed, for example, using a combination of single and/or double jumps or shifts, based on the number of colors being run in the pattern and the area of the pattern field being formed by each specific color. Such a combination of single and double shift jumps, or steps can be utilized to avoid over-tufting or engaging previously sewn tufts as the needle bar is shifted transversely and the backing material is advanced at its effective or operative stitch rate. The backing also can be shifted by backing or jute shifters, etc., either in conjunction with or separately from the needle bar shifting mechanism.

As the needles penetrate the backing B, as indicated in FIGS. 1 and 2, the loopers or hooks 50 of the gauge part assembly 30 will be reciprocated toward the needles, in the direction of arrow 54 so as to engage and pick or pull loops of yarns from their associated or corresponding needles. In addition, the actuators 66 for the loopers or hooks can be selectively controlled and engaged so as to cause selected ones of the loopers or hooks to be extended or retracted so that the bills 63 and throat portions 62 thereof are located at a desired position with respect to the needles as the needles 36 penetrate and complete their stroke into and out of the backing. As indicated in FIGS. 11A-12C, the location or positioning of the bills and/or throat portions of the loopers or hooks can be varied between a fully extended position or elevation and a lowered or retracted, "no-sew" position at which loops of yarns generally can be substantially prevented from being picked up and/or formed by such loopers or hooks to provide a selective pick-up of loops of yarns, including no loop(s) of yarns being picked up, and control of the lengths of the loops of yarns that are selectively picked up from the yarns presented at each of the stitch locations or pixels in accordance with the instructions for the pattern being formed. As a result, the locations at which the loops of the selected or desired face yarns to be shown in the "finished" pattern are picked up from the needles by the loopers or hooks can be controlled, with the formation of the resultant tufts from such picked up loops of yarns remaining within the backing further being controlled so as to be able to be formed at a variety of different pile heights.

The type/color of yarn of each series of yarns being presented at each pixel or stitch location that is to be retained or shown on the face of the backing at a particular stitch location generally will be determined according to the pattern instructions or programming for the formation of the tufted pattern. Controlling the activation and/or positioning of the loopers or hooks 50 corresponding to or associated with the needles carrying such yarns can enable the tufting machine to selectively pick-up and retain a loop of that yarn at each stitch location at which such yarns are to remain in accordance with the pattern, so as to form a resultant tuft of such a yarn at a selected pile height. For example, if the presented yarn is not to be shown or appear, the corresponding looper or hook can be retracted to a no-sew position so that a loop of yarn is not picked-up, and the yarn feed therefor controlled so that such a yarn is not retained at the pixel or stitch location. For the retained yarns/colors, i.e., the yarns appearing on the face of the patterned tufted article, the positions or elevations of the loopers or hooks and the yarn feed mechanisms feeding these yarns generally can be cooperatively controlled so as to enable pick-up and formation of loops of such yarns sufficient to form tufts of a desired type and pile height.

The further control of the backing feed at an increased effective or operative process stitch rate (e.g., the actual rate at which stitches are formed in the backing) in accordance with the principles of the present disclosure further provides for a denser or compressed field of stitches or tufts per inch, so that the yarns being back-robbed are removed or pulsed low to an extent sufficient to avoid creation of undesired spaces or gaps between the retained face yarns (those appearing on the face of the tufted article according to the pattern) or interfering with or showing through such retained face yarns formed in the backing material. Additionally, the control system can perform yarn feed compensation and/or modeling of the yarn feed to help control and reduce the amount of non-retained or non-appearing yarns that may be "floating" on the back side of the backing material to further help reduce/minimize excess yarn feed and/or waste.

In addition, the yarn feed mechanisms controlling the feeding of each of the yarns to each of the needles can be selectively controlled to back-rob or pull the yarns carried by the needles substantially out of the backing material or with the reciprocation of the needles; and can retract or pull back/low some loops of yarns to a position substantially low enough to generally avoid such non-selected ends of yarns occupying a selected stitch location, or otherwise interfering with the placement of a selected face yarn or yarn to be shown in a particular color field being formed according to the pattern.

For example, in some embodiments, when selected or particular loopers or hooks are retracted to a fully retracted position or "no sew" position, no loop generally will be picked up from the needles associated with such fully retracted loopers or hooks, while the yarn feed is correspondingly controlled so that the yarns are allowed to move with their needles into and back out of the backing material. In addition, in some instances where loops of yarns are formed, such as when the loopers or hooks are at a fully extended position and form low loops, the resultant formed loops of yarns further can be back-robbed or pulled substantially low or out of the backing material by control of the yarn feed thereof to an extent so as to leave an amount of yarn engaged with or "tacked" to the backing, while substantially removing such yarns to an extent so that such non-selected ends of yarns generally will not interfere with the placement of a face appearing or selected yarn at a particular stitch location within the color field being sewn.

The placement of the non-appearing yarns being tacked or otherwise secured to the backing material also can be controlled to prevent the formation of such extended length tails that can later become caught or cause other defects in the finished tufted article. For example, the control system also can be programmed/set to tack or form low stitches of such non-appearing yarns at desired intervals, e.g., every 1 inch to 1.5 inches, although greater or lesser intervals also can be used. Yarn compensation also generally can be used to help ensure that a sufficient amount of yarns is fed when needed to enable the non-appearing yarns to be tacked into the backing material, while preventing the yarns from showing or bubbling up through another color, i.e., with the yarns being tacked into and projecting through one of the stitch yarns with several yarns being placed together. Additionally, where extended lengths or tails would be formed for multiple non-appearing yarns, the intervals at which such different yarns are tacked within the backing material can be varied (i.e., one at 1", another at 1.5", etc.,) so as to avoid such tacked yarns interfering with one another and/or the yarns of the color field being formed.

Still further, the actuators 66 also can be controlled, in conjunction with the control of the yarn feed mechanisms, to cause the formation of extended or elongated loops of yarns, such as by being engaged and retracting or lowering their respective loopers or hooks with a loop of yarn captured thereon. The captured loops of yarns thus can be further pulled and/or elongated, while the corresponding yarn feed also can be controlled for feeding of additional amounts of such yarns. As a result, even longer or greater length loops of yarns can be formed in the backing so as to create higher pile tufts and/or for creating other desired pattern effects, such as for tip shearing and/or other patterning features. The selective control of the actuators 66 for selectively retracting and extending their loopers or hooks 50 further can be used to provide additional variation or transitioning steps or pile heights within a pattern, for example, being controlled as needed to provide more gradual or subtle differences or changes in pile heights, or for providing more dramatic or defined separations between pile heights of the tufts of yarns being formed.

Accordingly, across the width of the tufting machine, the control system will control the shifting and feeding of the yarns of each color or desired pattern texture effect so that each color that can or may be sewn at a particular tuft location or pattern pixel will be presented within that pattern pixel space or tuft location for sewing, but only the selected yarn tufts for a particular color or pattern texture effect will remain in that tuft/stitch location or pattern pixel. As further noted, it is also possible to present additional or more colors to each of the loopers or hooks during a tufting step in order to form mixed color tufts or to provide a tweed effect as desired, wherein two or more stitches or yarn will be placed at desire pattern pixel or tuft location. The results of the operation of the stitch distribution control system accordingly provide a multi-color visual effect of pattern color or texture effects that are selectively placed in order to get the desired density and pattern appearance for the finished tufted article. This further enables the creation of a wider variety of geometric, free flowing and other pattern effects by control of the placement of the tufts or yarns at selected pattern pixels or tuft locations.

The system and method for tufting sculptured and multiple pile height patterns articles of the present disclosure thus can enable an operator to develop and run a variety of tufted patterns having a variety of looks, textures, etc., at the tufting machine without necessarily having to utilize a design center to draw out and create the pattern. Instead, with the present disclosure, in addition to and/or as an alternative to manually preparing patterns or using a design center, the operator can scan an image (i.e., a photograph, drawing, jpeg, etc.,) or upload a designed pattern file at the tufting machine and the stitch distribution control system can read the image and develop the program steps or parameters to thereafter control the tufting machine substantially without further operator input or control necessarily required to form the desired tufted patterned article.

The foregoing description generally illustrates and describes various embodiments of the present disclosure. It will, however, be understood by those skilled in the art that various changes and modifications can be made to the above-discussed construction of the present disclosure without departing from the spirit and scope of the present disclosure as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present disclosure. Accordingly, various features and characteristics of the present disclosure as discussed herein may be selectively interchanged and applied to other illustrated and non-illustrated embodiments of the present disclosure, and numerous variations, modifications, and additions further can be made thereto without departing from the spirit and scope of the present disclosure as set forth in the appended claims.

What is claimed:

1. A gauge part assembly for a tufting machine, comprising:

a plurality of gauge modules each having a body;

a plurality of inserts received within the body of each module;

wherein each insert comprises a metal, metal carbide, ceramics, powdered metal materials, including metal powders including tungsten, titanium, or combinations thereof, having a hardness greater than a hardness of the body of each module;

a plurality of gauge parts received within the body of each module;

wherein the gauge parts are carried with the modules in a first direction toward and away from engagement with a plurality of needles, and are selectively movable in a second direction through the modules;

wherein the inserts are configured to define contact areas along which the gauge parts slide as the gauge parts are moved in the second direction through the modules; and wherein the body of each module comprises a skeletonized construction configured to provide a reduced weight or profile to the modules.

2. The gauge part assembly of claim 1, further comprising a plurality of actuators coupled to the gauge parts, the actuators each being selectively actuatable so as to move the gauge parts coupled thereto in the second direction between one or more extended positions for picking loops of yarns from the needles and a retracted position adapted to substantially avoid picking loops of yarns from the needles.

3. The gauge part assembly of claim 1, wherein the inserts comprise one or more pins located adjacent at least one passage extending through the body of each module and along which the gauge parts are slidably received such that edge portions of the gauge parts contact the pins as the gauge parts slide along the passage.

4. The gauge part assembly of claim 1, wherein the inserts comprise a hardness of at least 75+RC.

5. The gauge part assembly of claim 1, wherein at least a portion of the body of one or more of the modules comprises a substantially h-shaped or y-shaped configuration including an open-ended recess defined along a front face thereof.

6. A tufting machine, comprising:

one or more needle bars having a plurality of needles mounted therealong;

at least one yarn feed mechanism feeding yarns to the needles; and a gauge part assembly comprising:

a plurality of gauge modules each having a body;

one or more inserts received within the body of each module;

wherein the one or more inserts comprise a material having a hardness greater than a hardness of a material forming the body of each module;

a series of gauge parts slidably received within the body of each module;

wherein the gauge parts are carried with the modules in a first direction toward and away from engagement with the needles, and are selectively movable in a second direction through the modules;

wherein the one or more inserts are configured to define contact areas along which the gauge parts slide as the gauge parts are moved in the second direction; and wherein the body of each module comprises a skeletonized construction configured to provide a reduced weight or profile to the modules.

7. The tufting machine of claim 6, wherein the material of the body of each module comprises a metal, polymer, composite or synthetic material, or combinations thereof; and wherein the material of the one or more inserts comprises a metal carbide, ceramics, powdered metal materials, including metal powders including tungsten, titanium, or combinations thereof.

8. The tufting machine of claim 6, further comprising a series of actuators coupled to the gauge parts and configured to control movement of the gauge parts in the second direction through the modules.

9. The tufting machine of claim 8, further comprising a control system including programming for controlling feeding of a plurality of yarns to the needles in coordination with control of one or more of the actuators so as to move selected ones of the gauge parts in the second direction between a retracted position and one or more extended positions with respect to the needles as the needles move into and out of a backing material for selectively forming tufts of the yarns in the backing material according to a pattern being formed.

10. The tufting machine of claim 9, further comprising a shift mechanism for shifting the one or more needle bars transversely across the backing material, and wherein the control system further comprises programming adapted to coordinate shifting of the one or more needle bars, movement of the gauge parts in the second direction, and feeding of the yarns to the needles as the needles are reciprocated into and out of the backing material, so as to present a series of the yarns to selected stitch locations along the backing material and withdraw non-selected yarns where the non-selected yarns are not picked up by one of the gauge parts.

11. The tufting machine of claim 10, wherein the control system further comprises programming for controlling feeding of the backing material, such that the backing material moved through a tufting zone at an actual stitch rate that is greater than a pattern stitch rate for the pattern being formed.

12. The tufting machine of claim 6, the body of each gauge module comprises a substantially h-shaped or y-shaped configuration including an open-ended recess defined along a front face thereof; and wherein the one or more inserts comprise a plurality of pins received within the body of each gauge module so as to define a plurality of contact areas for the gauge parts.

13. A tufting machine, comprising:

at least one needle bar having a plurality of needles mounted therealong;

a plurality of gauge parts received within the at least one module and configured to pick up yarns from the needles;

wherein the gauge parts are received within a series of modules formed from a material having a first hardness;

wherein the gauge parts are moveable through the modules;

at least one insert received within each module, each insert formed from a material having a second hardness that is greater than the first hardness of the material of the modules;

wherein the inserts are configured to define contact surfaces against which the gauge parts engage and slide as the gauge parts are moved through the modules; and a control system including programming for controlling movement of the gauge parts through the modules between a first position at which pick up of the yarns from corresponding needles by the gauge parts is substantially avoided, and a second position for picking up the yarns from the corresponding needles, and for controlling the at least one yam feed mechanism to control feeding of the yarns to the needles; and wherein the modules comprise a skeletonized body construction configured to provide a reduced weight or profile to the modules.

14. The tufting machine of claim 12, further comprising a shift mechanism for shifting the at least one needle bar, a backing material shifter, or a combination thereof.

15. The tufting machine of claim 13, wherein the control system further comprises programming adapted to coordinate shifting of the at least one needle bar or shifting of a backing material moving through the tufting machine, or a combination thereof, with the movement of the gauge parts through the body of the at least one module, and control of the feeding of the yams to the needles, so as to enable presentation of one or more yarns to selected stitch locations along the backing material.

16. The tufting machine of claim 14, wherein the control system further comprises programming configured to control movement of the backing material through the tufting machine at an actual stitch rate that is greater than a pattern stitch rate for a pattern being formed.

17. The tufting machine of claim 12, wherein the body of one or more of the modules comprises a substantially h-shaped or y-shaped configuration including an open-ended recess defined along a front face thereof.

18. The tufting machine of claim 17, wherein the at least one insert comprises a plurality of pins positioned on opposite sides of an open-ended recess defined along the body of the at least one module and defining a plurality of contact surfaces against which the gauge parts are engaged as the gauge parts move through the modules.

19. The tufting machine of claim 12, further comprising a plurality of actuators connected to the gauge parts; wherein the actuators are selectively actuatable to selectively move the gauge parts between their first and second positions.

20. The tufting machine of claim 12, wherein the material of the body of each module comprises a metal, polymer, composite or synthetic material, or combinations thereof; and wherein the material of each of the inserts comprises a metal carbide, ceramics, powdered metal materials, including metal powders including tungsten, titanium, or combinations thereof.

* * * * *